US009488390B2

(12) United States Patent
Xu

(10) Patent No.: US 9,488,390 B2
(45) Date of Patent: Nov. 8, 2016

(54) REGENERATOR, GM TYPE REFRIGERATOR AND PULSE TUBE REFRIGERATOR

(75) Inventor: Mingyao Xu, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 1063 days.

(21) Appl. No.: 13/586,049

(22) Filed: Aug. 15, 2012

(65) Prior Publication Data

US 2012/0304668 A1 Dec. 6, 2012

Related U.S. Application Data

(63) Continuation of application No. PCT/JP2011/056361, filed on Mar. 17, 2011.

(30) Foreign Application Priority Data

Mar. 19, 2010 (JP) ..... 2010-065038

(51) Int. Cl.
*F25B 9/00* (2006.01)
*F25B 9/14* (2006.01)
*F25B 9/10* (2006.01)

(52) U.S. Cl.
CPC ..... *F25B 9/145* (2013.01); *F25B 9/14* (2013.01); *F25B 9/10* (2013.01); *F25B 2309/003* (2013.01); *F25B 2309/1408* (2013.01); *F25B 2309/1418* (2013.01)

(58) Field of Classification Search
CPC .. F25B 9/145; F25B 9/14; F25B 2309/1408; F25B 2309/003; F25B 9/10; F25B 2309/1418
USPC ..... 62/6
See application file for complete search history.

(56) References Cited

U.S. PATENT DOCUMENTS 2,966,035 A * 12/1960 Gifford ..... F25B 9/004 62/6
3,692,099 A * 9/1972 Nesbitt ..... F25B 9/14 165/10
2006/0201163 A1 9/2006 Haefner et al.

FOREIGN PATENT DOCUMENTS

JP 58-000063 1/1983
JP 59-015773 1/1984
(Continued)

OTHER PUBLICATIONS

International Search Report mailed on Jun. 28, 2011.

*Primary Examiner* — Ryan J Walters
*Assistant Examiner* — Steve Tanenbaum
(74) *Attorney, Agent, or Firm* — IPUSA, PLLC

(57) ABSTRACT

A helium-cooling type regenerator includes first and second storage spaces. The first storage space is disposed in a region on a high-temperature side, and accommodates the regenerator material whose pressure is P1. The second storage space is disposed in a region on a low-temperature side, and accommodates the regenerator material whose pressure is P2, which is less than P1. A specific heat in the case where a pressure of the regenerator material accommodated in the first storage space is P2 is less than that in the case where the pressure of the regenerator material is P1, and a specific heat in the case where a pressure of the regenerator material accommodated in the second storage space is P1 is less than that in the case where the pressure of the regenerator material is P2.

4 Claims, 19 Drawing Sheets

(56) References Cited

FOREIGN PATENT DOCUMENTS

| | | |
|---|---|---|
| JP | 60-023761 | 2/1985 |
| JP | 62-112072 | 7/1987 |
| JP | 03-117855 | 5/1991 |
| JP | 07-146020 | 6/1995 |
| JP | 11-037582 | 2/1999 |
| JP | 2006-524307 | 10/2006 |

* cited by examiner

REGENERATOR, GM TYPE REFRIGERATOR AND PULSE TUBE REFRIGERATOR

CROSS-REFERENCE TO RELATED APPLICATIONS

This is a continuation of International Application No. PCT/JP2011/056361, filed on Mar. 17, 2011, which International Application is based on Japanese Priority Application No. 2010-65038, filed on Mar. 19, 2010, the entire contents of which are hereby incorporated by reference.

FIELD

The present invention is related to a regenerator. In particular, the present invention is related to a regenerator which can be used for a cold accumulation refrigerator.

BACKGROUND

A cold accumulation refrigerator such as a Gifford-McMahon (GM) refrigerator, a pulse tube refrigerator, etc., can generate the cold in a range from a low temperature of about 100 K to a cryogenic temperature of 4 K (Kelvin), and can be used for cooling a superconducting magnet, a detector or the like or in a cryopump, etc.

For example, according to the GM refrigerator, working gas such as helium gas compressed by a compressor is introduced to a regenerator where the working gas is cooled by a regenerator material in advance. Further, the working gas generates the cold according to expansion work in an expansion chamber, and passes through the regenerator again to return to the compressor. At that time, since the working gas is to be introduced again, it passes through the regenerator while cooling the regenerator material. This process is one cycle and the cold is thus generated periodically.

According to such a cold accumulation refrigerator, if it is necessary to generate the cryogenic temperature lower than 30 K, a magnetic material such as $HoCu_2$ is used as a regenerator material of the regenerator.

Recently, the use of helium gas as the regenerator material of the regenerator is contemplated. Such a regenerator is also referred to as a helium-cooling type regenerator. For example, US Patent Publication No. 2006/0201163 discloses using, as the regenerator material of the regenerator, plural capsules with thermal conductivity which are filled with helium gas.

FIG. 1 illustrates change characteristics of specific heat vs. temperature with respect to the helium gas and the $HoCu_2$ magnetic material. As is apparent from FIG. 1, in a cryogenic temperature range around about 10 K, the specific heat of the helium gas at a pressure of about 1.5 MPa exceeds the specific heat of the $HoCu_2$ magnetic material. Thus, in such a temperature range, more effective heat exchange can be performed by using the helium gas instead of using the $HoCu_2$ magnetic material.

SUMMARY

A helium-cooling type regenerator which accumulates the cold of working gas is provided, which includes:

at least first and second storage spaces along a temperature gradient direction in which the working gas flows, the first and second storage spaces accommodating helium gas as a regenerator material, wherein the first storage space is disposed in a region on a high-temperature side, and accommodates the regenerator material whose pressure is P1 during an operation of the helium-cooling type regenerator, the second storage space is disposed in a region on a low-temperature side, and accommodates the regenerator material whose pressure is P2, which is less than P1, during the operation of the helium-cooling type regenerator, a specific heat in the case where a pressure of the regenerator material accommodated in the first storage space is P2 is less than that in the case where the pressure of the regenerator material is P1, and a specific heat in the case where a pressure of the regenerator material accommodated in the second storage space is P1 is less than that in the case where the pressure of the regenerator material is P2.

DESCRIPTION OF EMBODIMENTS

In the following, embodiments for carrying out the present invention will be described in detail by referring to the accompanying drawings.

According to an ordinary helium-cooling type regenerator, the helium gas is used as a regenerator material. However, as is apparent from FIG. 1, the specific heat of the helium gas can change with respect to the temperature. For example, if it is assumed that the pressure of the helium gas is 1.5 MPa, the specific heat of the helium gas becomes smaller as the temperature of the helium gas moves away from around about 9 K where a peak value of the specific heat is obtained. This means that a cold accumulating capability of the regenerator substantially decreases if the temperature of the helium gas deviates from a predetermined range.

Accordingly, there is a need for a helium-cooling type regenerator which is capable of constantly maintaining a stable cold accumulating capability while being affected less by the influence of a change in specific heat due to a temperature change.

The present invention is made in such a context, and an object of the present invention is to provide a helium-cooling type regenerator which is capable of constantly maintaining a cold accumulating capability with more stability in comparison with conventional helium-cooling type regenerators. Further, another object of the present invention is to provide a refrigerator which includes such a regenerator.

First of all, for better understanding of the present invention, a general configuration of a cold accumulation refrigerator including a helium-cooling type regenerator is briefly explained.

Figure 2:
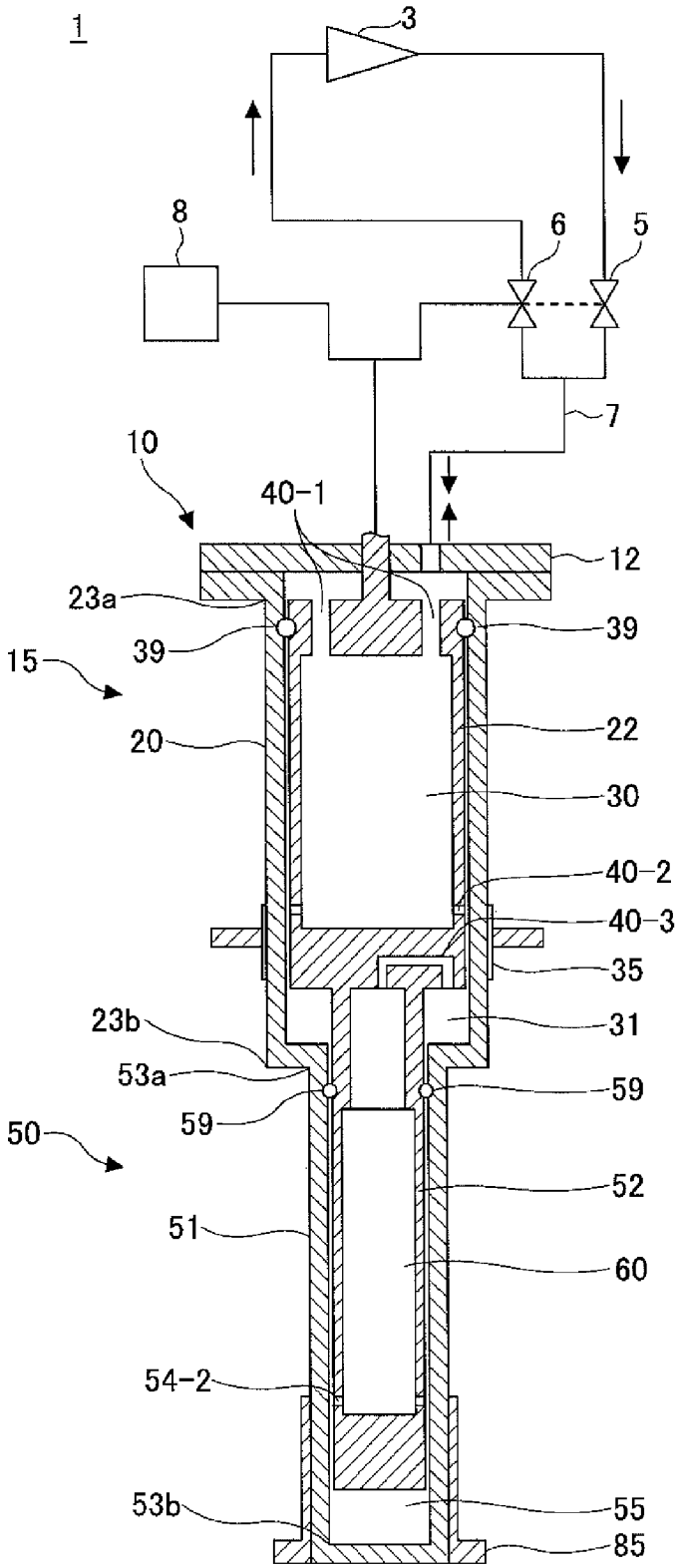
FIG. 2 is a diagram for schematically illustrating a general configuration of a GM refrigerator.

FIG. 2 is a diagram for schematically illustrating a general configuration of a GM (Gifford-McMahon) refrigerator as an example of a cold accumulation refrigerator.

The GM refrigerator 1 includes a gas compressor 3, and a two-stage cold head 10 which functions as a refrigerator. The cold head 10 includes a first stage cooling part 15 and a second stage cooling part 50 which are coupled such that they are coaxial with a flange 12.

The first stage cooling part 15 includes a hollow first stage cylinder 20; a first stage displacer 22 which is provided in the first stage cylinder 20 such that it can reciprocate in an axial direction; a first stage regenerator 30 which is installed in the first stage displacer 22; a first stage expansion chamber 31 which is provided in the first stage cylinder 20 on a cold end 23*b* side, which first stage regenerator 30 has a volume changed according to the reciprocating motion of the first stage displacer 22; and a first stage cooling stage 35 which is provided near the cold end 23*b* of the first stage cylinder 20. A first stage sealing is provided between an inner wall of the first stage cylinder 20 and an outer wall of the first stage displacer 22.

Plural first stage warm end channels 40-1 are provided at a warm end 23*a* of the first stage cylinder 20 for having the helium gas flow into or out of the first stage regenerator 30. Further, plural first stage cold end channels 40-2 are provided at the cold end 23*b* of the first stage cylinder 20 for having the helium gas flow into or out of the first stage regenerator 30 and the first stage expansion chamber 31.

The second stage cooling part 50 has substantially the same configuration as the first stage cooling part 15, and includes a hollow second stage cylinder 51; a second stage displacer 52 which is provided in the second stage cylinder 51 such that it can reciprocate in an axial direction; a second stage regenerator 60 which is installed in the second stage displacer 52; a second stage expansion chamber 55 which is provided in the second stage cylinder 51 on a cold end 53*b* side, which second stage expansion chamber 55 has a volume changed according to the reciprocating motion of the second stage displacer 52; and a second stage cooling stage 85 which is provided near the cold end 53*b* of the second stage cylinder 51. A second stage sealing 59 is provided between an inner wall of the second stage cylinder 51 and an outer wall of the second stage displacer 52. Plural second stage warm end channels 40-3 are provided at a warm end 53*a* of the second stage cylinder 51 for having the helium gas flow into or out of the first stage regenerator 30. Further, plural second stage cold end channels 54-2 are provided at the cold end 53*b* of the second stage cylinder 51 for having the helium gas flowed into or out of the second stage expansion chamber 55.

According to the GM refrigerator 1, the high-pressure helium gas from the gas compressor 3 is supplied to the first stage cooling part 15 via a valve 5 and a pipe 7, and the low-pressure helium gas is exhausted to the gas compressor 3 from the first stage cooling part 15 via the pipe 7 and a valve 6. The first stage displacer 22 and the second stage displacer 52 are reciprocated by a drive motor 8. Further, in synchronization with this, opening/closing operations of the valves 5 and are performed to control intake and exhaust timings of the helium gas.

The warm end 23*a* of the first stage cylinder 20 is set to have a room temperature, for example, and the cold end 23*b* is set to have a temperature between 20 K and 40 K, for example. The warm end 53*a* of the second stage cylinder 51 is set to have a temperature between 20 K and 40 K, for example, and the cold end 53*b* is set to have a temperature 4 K, for example.

Next, an operation of the GM refrigerator having the configuration described above is briefly explained.

At first, such an initial status is assumed where the valve 5 is in its closed status, the valve 6 is in its closed status, and the first stage displacer 22 and the second stage displacer 52 are located at bottom dead points in the first stage cylinder 20 and the second stage cylinder 51, respectively.

Then, if the valve 5 is opened while the exhaust valve 6 is in its closed status, the high-pressure helium gas flows from the gas compressor 3 to the first cooling part 15. The high-pressure helium gas flows from the first stage warm end channels 40-1 into the first stage regenerator 30 where the high-pressure helium gas is cooled to a predetermined temperature with a regenerator material of the first stage regenerator 30. The cooled helium gas flows into the first stage expansion chamber 31 from the first stage cold end channels 40-2.

A part of the high-pressure helium gas having flowed into the first stage expansion chamber flows into the second stage regenerator 60 via the second stage warm end channels 40-3. This helium gas is cooled to a further lower predetermined temperature with a regenerator material of the second stage regenerator 60 and flows into the second stage expansion chamber 55 via the second stage cold end channels 54-2. As the result of this, the helium gas in the first stage expansion chamber 31 and the second stage expansion chamber 55 becomes high pressure status.

Then, the first stage displacer 22 and the second stage displacer 52 are moved to upper dead points and the valve 5 is closed. Further, the valve 6 is opened. Thus, the helium gas in the first stage expansion chamber 31 and the second stage expansion chamber 55 changes from the high pressure status to a low pressure status and its volume expands, thereby generating the cold in the first stage expansion chamber 31 and the second stage expansion chamber 55. Further, as a result of this, the first stage cooling stage 35 and the second stage cooling stage 85 are cooled, respectively.

Then, the first stage displacer 22 and the second stage displacer 52 are moved to the bottom dead points. As a result of this, the low-pressure helium gas flows along a reversed flow path with respect to the flow path described above to return to the gas compressor 3 via the valve 6 and the pipe while cooling the first stage regenerator 30 and the second stage regenerator 60. After that, the valve 6 is closed.

The operation described above is an operation of one cycle, and by repeating the operation, the first stage cooling stage 35 and the second stage cooling stage 85 can absorb heat from a target object to be cooled (not illustrated) which is thermally coupled thereto, respectively, to cool it.

If it is necessary to form the cryogenic temperature less than 30 K in the second stage cooling stage 85, for example, a magnetic material such as $HoCu_2$ is used as a regenerator material of the second stage regenerator 60.

Further, recently, it is proposed to use a so-called helium-cooling type regenerator in which the helium gas is used as the regenerator material of the regenerator.

Figure 3:
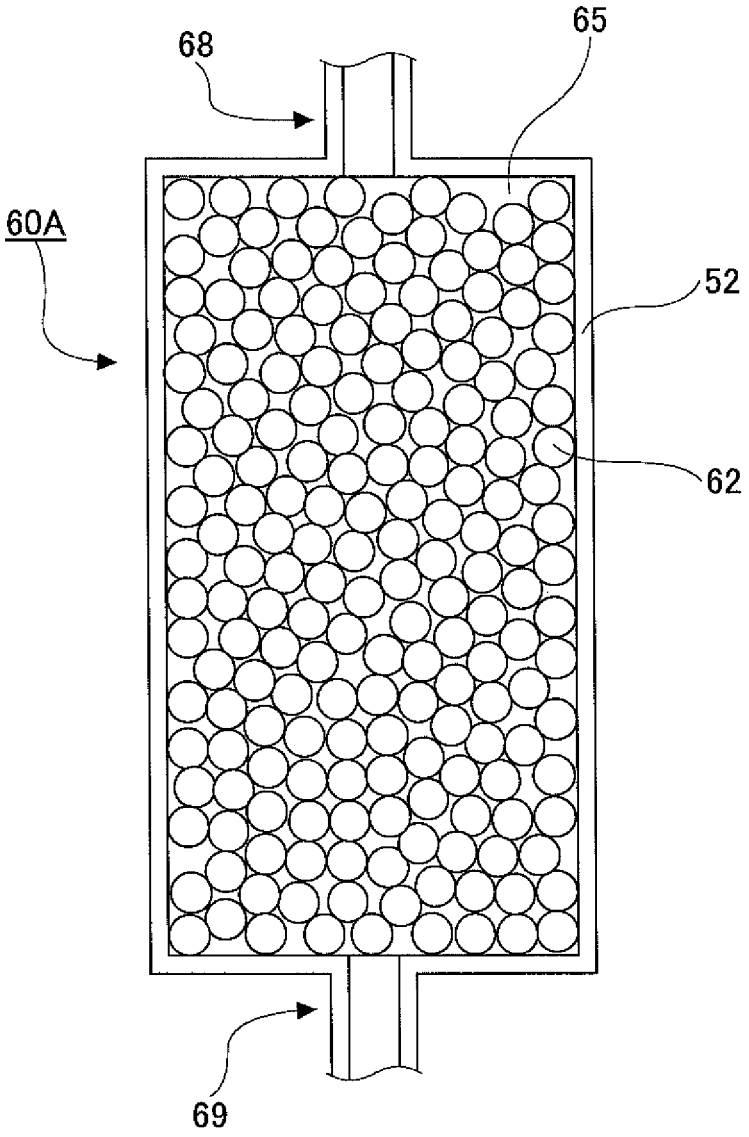
FIG. 3 is a diagram for schematically illustrating an example of a conventional helium-cooling type regenerator.

FIG. 3 schematically illustrates an example of a conventional helium-cooling type regenerator 60A which is used as the second stage regenerator 60 of the refrigerator 1 as illustrated in FIG. 2.

As illustrated in FIG. 3, the conventional helium-cooling type regenerator 60A is used as the second stage regenerator in the second stage displacer 52 as illustrated in FIG. 2, for example.

The helium-cooling type regenerator 60A includes a first working gas channel 68 and a second working gas channel 69. The first working gas channel 68 is connected to the GM refrigerator 1 on the first stage expansion chamber 31 side. The second working gas channel 69 is connected to the GM refrigerator 1 on the second stage expansion chamber 55 side.

The helium-cooling type regenerator 60A includes plural metal capsules 62 which are substantially spherical in shape. The capsules 62 are filled with the helium gas as the regenerator material. Further, the working gas flows through a space 65 where there are no capsules 62.

Figure 1:
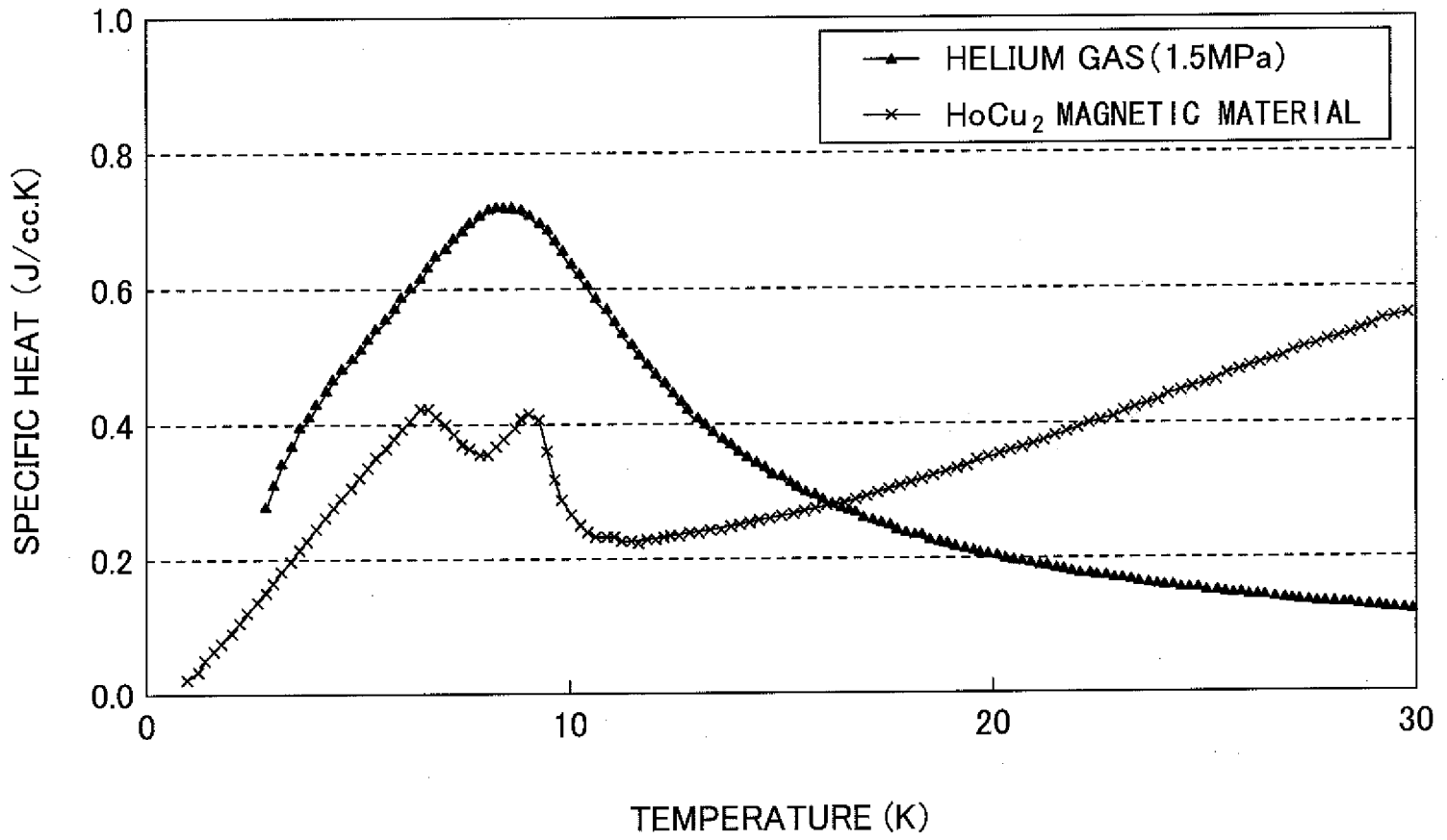
FIG. 1 is a graph for illustrating change characteristics of specific heat vs. temperature with respect to helium gas and a $HoCu_2$ magnetic material.

As illustrated in FIG. 1, as usual, the helium gas has a greater specific heat at around 10 K in comparison with the magnetic material such as $HoCu_2$. Thus, by using the helium gas as the regenerator material, the working gas (helium gas) circulating in the space 65 in the regenerator 60A can be effectively cooled.

However, as is apparent from FIG. 1, the specific heat of the helium gas changes with the temperature change. Thus, if the helium gas is used as the regenerator material, there is a problem that the cold accumulating capability of the regenerator changes due to the temperature change of the helium gas. This means that even if the regenerator material serves a good cold accumulating capability when the regenerator material is within a certain temperature region, there is a probability that an appropriate cold accumulating capability of the regenerator material cannot be obtained if the temperature of the regenerator material changes to fall within another certain temperature region.

In particular, under normal circumstances, the regenerator has a temperature gradient along a main flow direction of the working gas (an up-and-down direction in FIG. 3). However, if there is such a temperature gradient, the specific heat of the regenerator material and thus the cold accumulating capability changes substantially along the temperature gradient direction, resulting in a problem that an average cold accumulating capability of the regenerator is reduced.

In this connection, the helium-cooling type regenerator according to the embodiment, comprises:

at least two storage spaces along a temperature gradient direction in which a working gas flows, the storage spaces accommodating helium gas as a regenerator material, wherein the first storage space is disposed in a region on a high-temperature side, and accommodates the regenerator material whose pressure is P1 during an operation of the helium-cooling type regenerator, the second storage space is disposed in a region on a low-temperature side, and accommodates the regenerator material whose pressure is P2, which is less than P1, during the operation of the helium-cooling type regenerator, a specific heat in the case where a pressure of the regenerator material accommodated in the first storage space is P2 is less than that in the case where the pressure of the regenerator material is P1, and a specific heat in the case where a pressure of the regenerator material accommodated in the second storage space is P1 is less than that in the case where the pressure of the regenerator material is P2.

Figure 4:
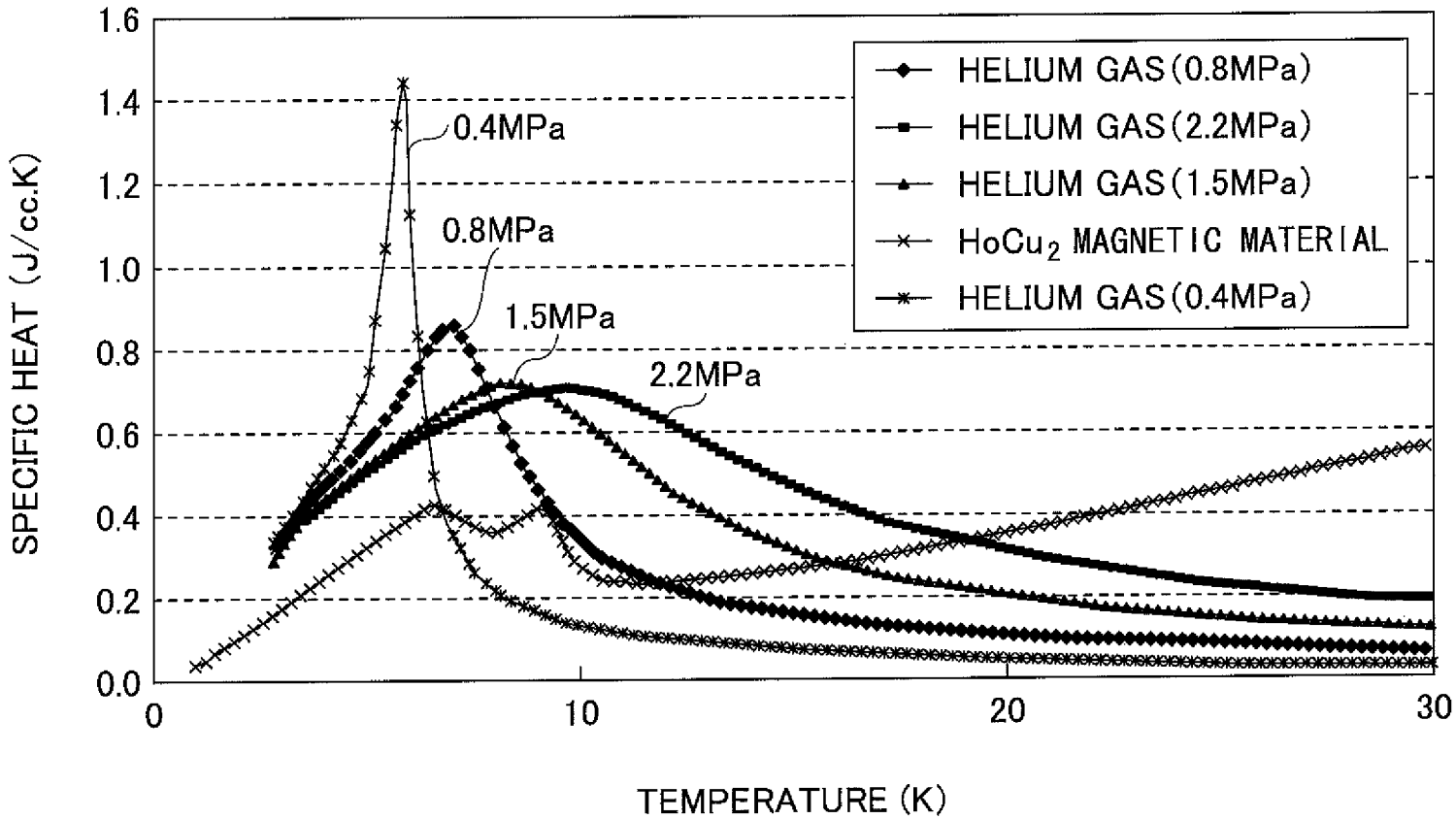
FIG. 4 is a graph for illustrating change characteristics of specific heat vs. temperature with respect to helium gas at respective pressures and the $HoCu_2$ magnetic material.

FIG. 4 is a graph for illustrating change characteristics of specific heat vs. temperature with respect to helium gas at respective pressures and the $HoCu_2$ magnetic material.

As is apparent from FIG. 4, the specific heat of the helium gas vs. temperature changes according to the pressure. For example, if the pressure of the helium gas is 0.4 MPa, the peak of the specific heat appears at a temperature of about 5 K. On the other hand, as the pressure of the helium gas increases to 0.8 MPa, 1.5 MPa and 2.2 MPa, the peak temperature of the specific heat changes to about 7 K, 9 K and 10 K, respectively.

Further, in FIG. 4, the pressure of the helium gas at which the maximum specific heat is obtained is as follow.

(i) about 0.4 MPa in a temperature region less than about 6 K.

(ii) 0.8 MPa in temperature region between about 6 K and about 8 K.

(iii) 1.5 MPa in temperature region between about 8 K and about 9.5 K.

(iv) 2.2 MPa in temperature region greater than about 9.5 K.

In this way, the pressure of the helium gas at which the maximum specific heat is obtained changes according to the temperature.

Therefore, according to the embodiment, the regenerator is configured such that the pressure of the regenerator material changes between the respective temperature region portions of the regenerator such that the helium gas in the respective portions has pressures at which the specific heat becomes high. This arrangement can reduce, to some degree, the problem that the specific heat of the regenerator material changes due to the temperature and thus an appropriate cold accumulating capability can not obtained. Further, as a result of this, the regenerator can be obtained which can maintain a stable cold accumulating capability as a whole without being affected by the influence of the change in the specific heat due to the temperature change.

In the following, details are described.

First Embodiment

Figure 5:
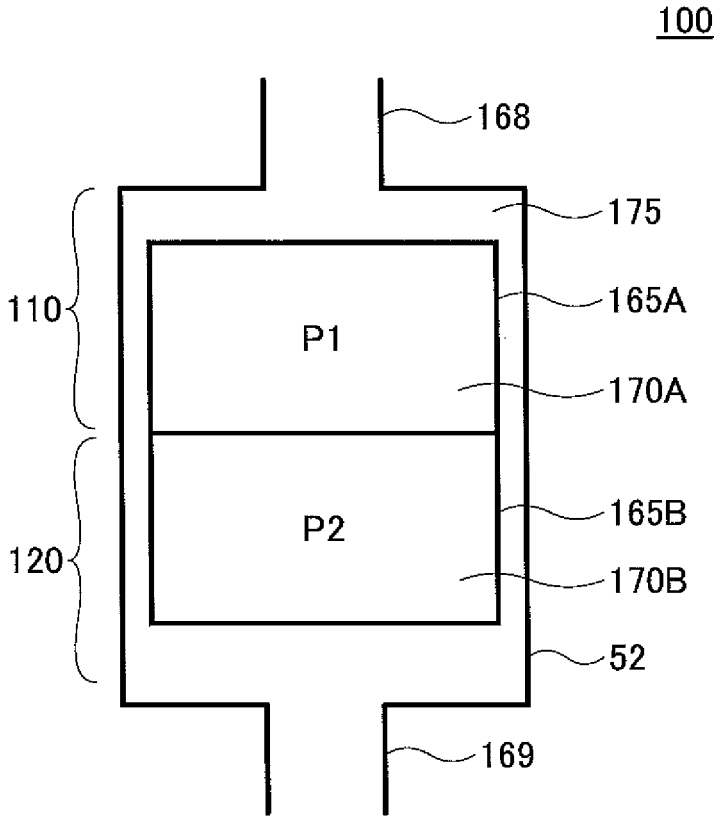
FIG. 5 is a cross-sectional view for schematically illustrating an example of a helium-cooling type regenerator according to the embodiment.

FIG. 5 is a cross-sectional view for schematically illustrating an example of a helium-cooling type regenerator according to the first embodiment.

As illustrated in FIG. 5, the helium-cooling type regenerator 100 according to the first embodiment is provided in a second stage displacer 52 of the GM refrigerator described above.

The regenerator 100 according to the first embodiment includes a first working gas channel 168 and a second working gas channel 169.

The helium-cooling type regenerator 100 has a first container 165A and a second container 165B therein. The helium-cooling type regenerator 100 includes a space 175 in which the first container 165A and the second container 165B don't exist.

The working gas passes through the space 175 via the first working gas channel 168 and the second working gas channel 169. However, the space 175 is not in fluid communication with the inside of the first container 165A and the inside of the second container 165B. Thus, the working gas does not enter the first container 165A and the second container 165B.

The first container 165A is provided on the warm side 110 of the regenerator 100 (on an upper side of the regenerator 100 in the example illustrated in FIG. 5), and the second container 165B is provided on the cold side 120 of the regenerator 100 (on a lower side of the regenerator 100 in the example illustrated in FIG. 5).

A regenerator material (helium gas) 170A is accommodated in the first container 165A. A regenerator material (helium gas) 1708 is accommodated in the second container 165B. The pressure of the helium gas 170A in the first container 165A is P1, and the pressure of the helium gas 170B in the second container 165B is P2, where P1 is greater than P2.

It is noted that, under normal circumstances, the pressures P1 and P2 are not fixed values, and change within temperature ranges of the first container 165A and the second container 165B. In other words, the pressures P1 and P2 are values which vary in certain ranges. Thus, it is noted that the relationship "P1 is greater than P2" means that the minimum value of the pressure P2 is smaller than the minimum value of the pressure P1.

Here, the pressure P1 of the regenerator material 170A and the pressure P2 of the regenerator material 170B are selected such that the specific heats of the helium gas in the containers 165A and 165B are great in the corresponding temperature regions to which the containers 165A and 165B are exposed.

Figure 6:
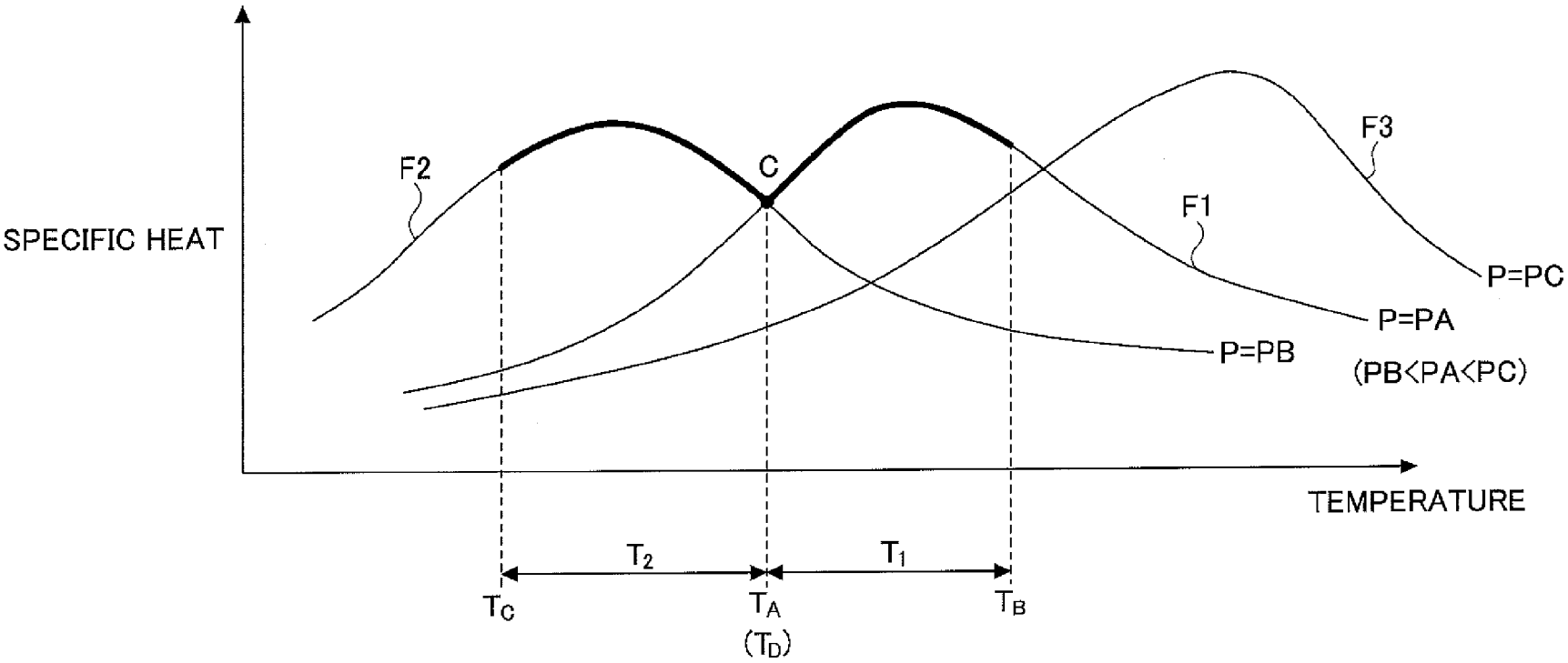
FIG. 6 is a diagram for explaining a concept in determining pressures of regenerator materials in the regenerator according to the embodiment.

In the following, this idea is explained in detail with reference to FIG. 6. FIG. 6 is a diagram for explaining a concept in determining the pressures P1 and P2 of the regenerator materials 170A and 170B according to the embodiment. In FIG. 6, a lateral axis indicates a temperature (in unit K) and a vertical axis indicates a specific heat of the regenerator material (in unit J/(cc K)).

First of all, it is assumed that the first container 165A is disposed in a portion in the regenerator 100 which has a temperature region T1. Here, the temperature region T1 is between the lowest temperature TA and the highest temperature TB. In this case, the pressure P1 of the regenerator material 170A in the first container 165A is selected such that the specific heat becomes maximum in the temperature region T1.

Here, the wider the temperature region T1 is, the wider option of the pressure of the helium gas to be selected as the pressure P1 becomes. Specifically, the helium gas pressure at which the specific heat becomes maximum can have a certain range. Thus, in fact, the pressure P1 of the regenerator material 170A may be selected from the range of the pressure in which the specific heat becomes maximum.

For example, in the case of the example illustrated in FIG. 6, the pressure, at which the peak of the specific heat of the helium gas appears in the temperature region T1, that is to say, the pressure PA, which has a change characteristic of specific heat vs. temperature indicated by F1, is selected as the pressure P1 of the regenerator material 170A.

Next, it is assumed that the second container 165B is disposed in a portion in the regenerator 100 which has a temperature region T2. Here, the temperature region T2 is between the lowest temperature TC and the highest temperature TD. Further, TC is less than TA and TD is less than TB. It is noted that in the example illustrated in FIG. 6 it is assumed that TA is equal to TD; however, the relationship between TA and TD is not limited to this relationship, and thus TA may be less than TD or TA may be greater than TD.

In this case, the pressure P2 of the regenerator material 170B in the second container 165B is selected such that the specific heat becomes maximum in the temperature region T2.

Here, the wider the temperature region T2 is, the wider option of the pressure of the helium gas to be selected as the pressure P2 becomes. Specifically, the pressure at which the specific heat becomes maximum can have a certain range. Thus, in fact, the pressure P2 of the regenerator material 170B may be selected from the range of the pressure in which the specific heat becomes maximum.

For example, in the case of the example illustrated in FIG. 6, the pressure, at which the peak of the specific heat of the helium gas appears in the temperature region T2, that is to say, the pressure PB, which has a change characteristic of specific heat vs. temperature indicated by F2, is selected as the pressure P2 of the regenerator material 170B.

With this arrangement, the helium gas, which has the pressure at which the specific heat becomes high and an appropriate cold accumulating capability is obtained, can be selected as the regenerator material of the second container 165B.

The regenerator materials in the respective containers thus obtained by the operation described above have a change characteristic of specific heat vs. temperature indicated by a bold line in FIG. 6. Thus, it is possible to provide the regenerator material with an appropriate cold accumulating capability over a whole temperature range of the regenerator 100 between TC and TB.

Here, if it is assumed that the minimum temperature to which the first container 165A is exposed is TA and a range (i.e., a range between TA and TD) of the highest temperature TD to which the second container 165B is exposed is a temperature range TP, it is preferred that a change characteristic curve (F2, for example) of specific heat vs. temperature at the pressure (PB, for example) selected as the pressure P2 of the regenerator material 170B and a change characteristic curve (F1, for example) of specific heat vs. temperature at the pressure (PA, for example) selected as the pressure P1 of the regenerator material 170A have an intersection in the temperature range TP. With this arrangement, the influence of the temperature change on the specific heat of the regenerator material can be reduced with increased reliability.

For example, in the example illustrated in FIG. 6, the change characteristic curve F1 of specific heat vs. temperature at the pressure PA and the change characteristic curve F2 of specific heat vs. temperature at the pressure PB intersect at a point C at the temperature TA (TD), and thus the condition described above is met.

Figure 7:
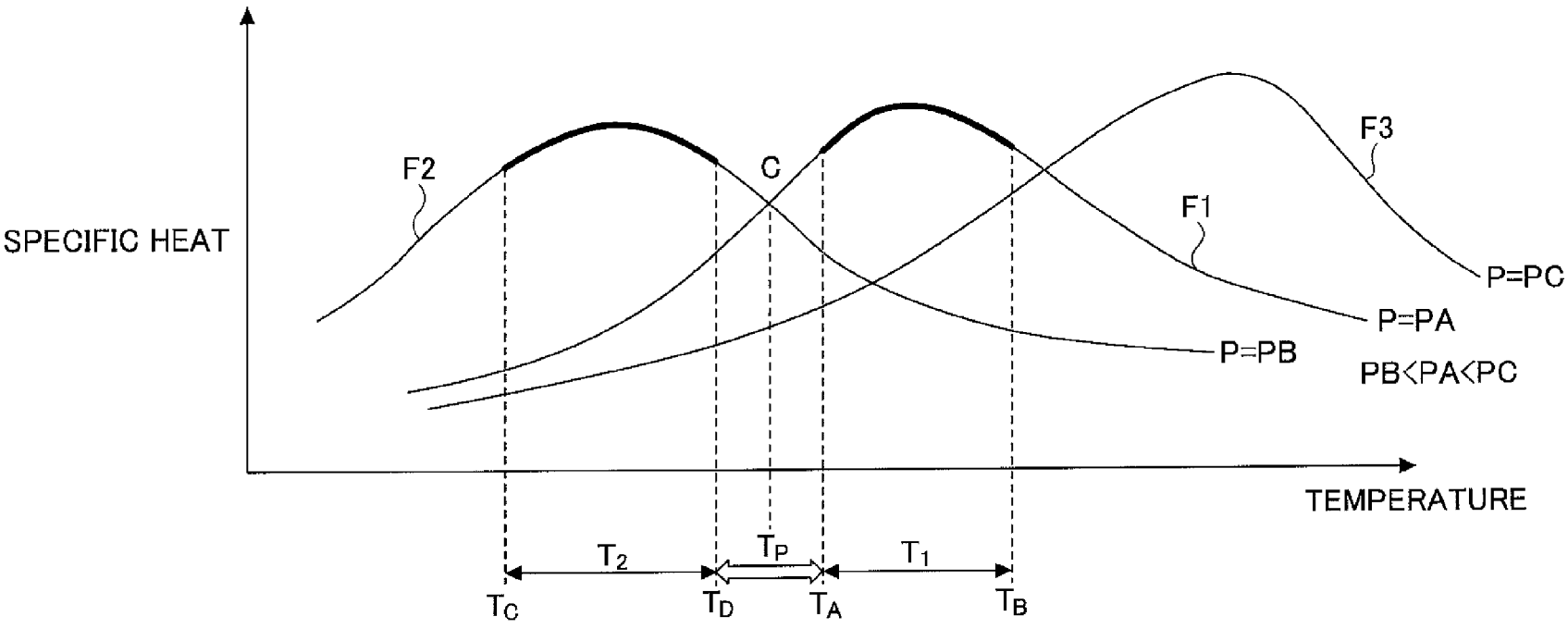
FIG. 7 is a diagram for explaining a concept in determining a pressure of a regenerator material in the regenerator according to the embodiment.

Further, if the temperature range T1 of the first container 165A and the temperature range T2 of the second container 165B are away from each other, that is to say, if TD is smaller than TA, the helium gas in the first container 165A and the second container 165B can have the helium gas accommodated therein with the pressures at which appropriate specific heats can be obtained, when the pressure PA is adopted as the pressure P1 of the regenerator material 170A and the pressure PB is adopted as the pressure P2 of the regenerator material 170B, as illustrated in FIG. 7 (see a part indicated by a bold line).

Figure 8:
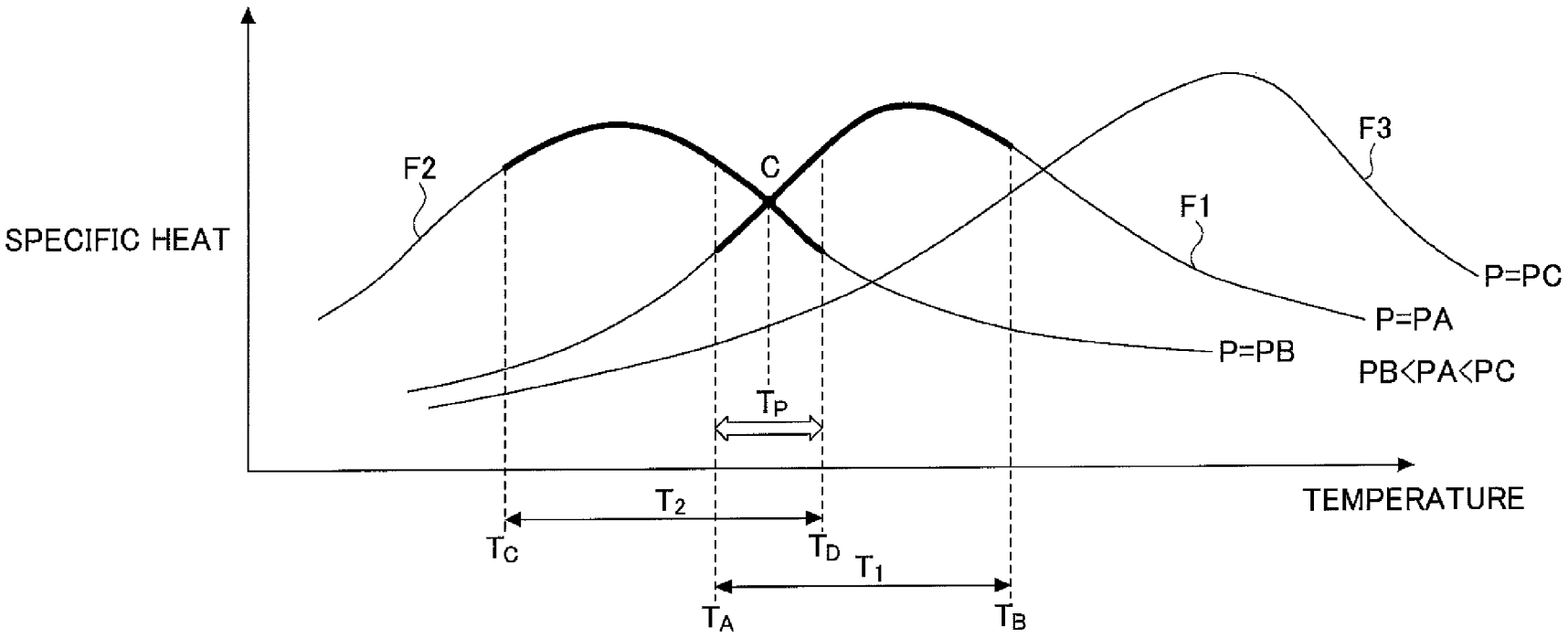
FIG. 8 is a diagram for explaining a concept in determining a pressure of a regenerator material in the regenerator according to the embodiment.

Further, if the temperature range T1 of the first container 165A and the temperature range T2 of the second container 165B are partly overlapped, that is to say, if TD is greater than TA, the pressure PA is adopted as the pressure P1 of the regenerator material 170A and the pressure PB is adopted as the pressure P2 of the regenerator material 170B, as illustrated in FIG. 8. Under normal circumstances, with this arrangement, the helium gas in the first container 165A and the second container 165B can have the helium gas accommodated therein with the pressures at which appropriate specific heats can be obtained.

According to the regenerator configured as described above, when the high-pressure working gas is introduced to the space 175 via the first working gas channel 168, for example, the working gas is cooled by the regenerator material 170A in the first container 165A. Further, the working gas is cooled by the regenerator material 170B in the second container 165B, and ejected from the regenerator 100 via the second working gas channel 169.

Next, the low-pressure working gas is introduced to the space 175 via the second working gas channel 169, and the working gas transfers the cold to the regenerator material 170B in the second container 165B. In this way, the regenerator material 170B is cooled.

The pressure P2 of the regenerator material 170B is less than the pressure P1 of the regenerator material 170A. Further, the specific heat of the regenerator material 170B is greater than the specific heat of the regenerator material 170A in the same temperature region at the pressure P1 (see FIGS. 6 through 8). For this reason, the regenerator material 170B can more effectively accumulate the cold of the working gas in comparison with the case where the working gas comes in contact with the regenerator material 170A at the pressure P1.

Next, the low-pressure working gas transfers the cold to the regenerator material 170A in the first container 165A.

The pressure P1 of the regenerator material 170A is greater than the pressure P2 of the regenerator material 170B. Further, the specific heat of the regenerator material 170A is greater than the specific heat of the regenerator material 170B in the same temperature region at the pressure P2 (see FIGS. 6 through 8). For this reason, the regenerator material 170A can more effectively accumulate the cold of the working gas in comparison with the case where the working gas comes in contact with the regenerator material 170B at the pressure P2.

After that, the low-pressure working gas is ejected from the regenerator 100 via the first working gas channel 168.

As a result of these operations, according to the regenerator 100 according to the embodiment, a regenerator can be obtained which can maintain a stable cold accumulating capability as a whole without being affected by the influence of the change in the specific heat due to the temperature change.

If it is assumed that the regenerator 100 according to the embodiment is provided in the second stage displacer 52 of the GM refrigerator 1 illustrated in FIG. 2, it is preferred that the first container 165A is disposed in a temperature region greater than or equal to about 6 K, and the pressure P1 of the regenerator material 170A is preferably greater than or equal to 0.8 MPa and less than or equal to 3.5 MPa, and more preferably greater than or equal to 1.5 MPa and less than or equal to 2.2 MPa. Similarly, it is preferred that the second container 165B is disposed in a temperature region less than or equal to about 10 K, and the pressure P2 of the regenerator material 170B is preferably greater than or equal to 0.1 MPa and less than or equal to 2.2 MPa, and more preferably greater than or equal to 0.4 MPa and less than or equal to 1.5 MPa.

Second Embodiment

Figure 9:
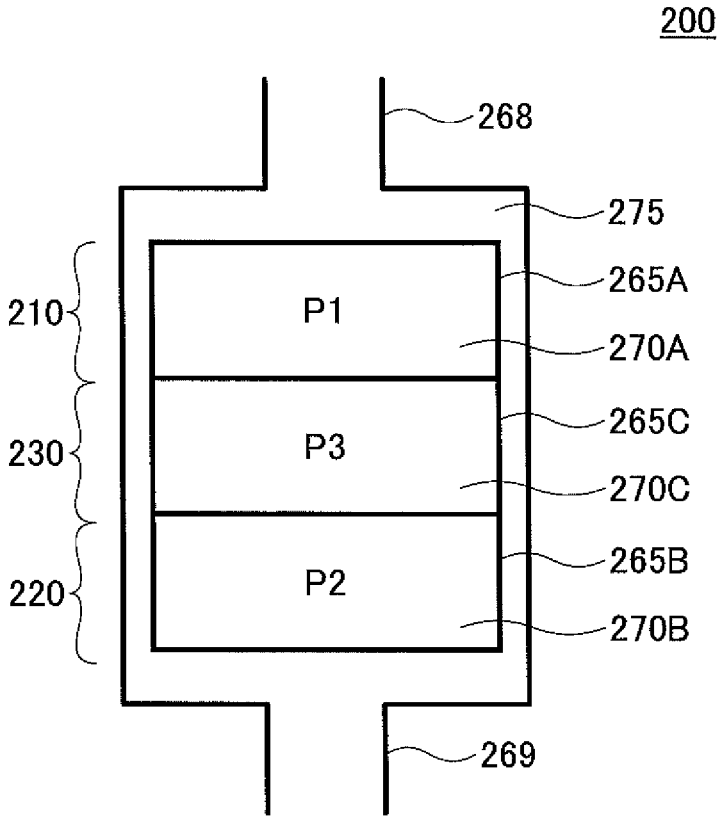
FIG. 9 is a cross-sectional view for schematically illustrating another example of a helium-cooling type regenerator according to the embodiment.

FIG. 9 is a cross-sectional view for schematically illustrating an example of a helium-cooling type regenerator according to the second embodiment.

A regenerator 200 includes a first working gas channel 268 and a second working gas channel 269, as illustrated in FIG. 9.

The helium-cooling type regenerator 200 has a first container 265A, a second container 265B and a third container 265C therein. The helium-cooling type regenerator 200 includes a space 275 in which the first container 265A, the second container 265B and the third container 265C don't exist.

The working gas passes through the space 275 via the first working gas channel 268 and the second working gas channel 269. However, the space 275 is not in fluid communication with the inside of the first container 265A, the inside of the second container 265B and the inside of the third container 265C. Thus, the working gas does not enter the first container 265A, the second container 265B and the third container 265C.

The first container 265A is provided on the warm side 210 of the regenerator 200 (on an upper side of the regenerator 200 in the example illustrated in FIG. 9), and the second container 265B is provided on the cold side 220 of the regenerator 200 (on a lower side of the regenerator 200 in the example illustrated in FIG. 9). The third container 265C is provided on an intermediate temperature side 230 (on an intermediate stage side of regenerator 200 in the example illustrated in FIG. 9), that is to say, between the first container 265A and the second container 265B.

A regenerator material (helium gas) 270A is accommodated in the first container 265A. A regenerator material (helium gas) 270B is accommodated in the second container 265B. A regenerator material (helium gas) 270C is accommodated in the third container 265C.

The pressure of the helium gas 270A in the first container 265A is P1, the pressure of the helium gas 270B in the second container 265B is P2, and the pressure of the helium gas 270C in the third container 265C is P3, where P1>P3>P2.

It is noted that, under normal circumstances, the pressures 21, 22 and 23 are not fixed values, and change within temperature ranges of the first container 265A, the second container 265B and the third container 265C. In other words, the pressures P1, P2 and P3 are values which vary in certain ranges. Thus, it is noted that the relationship "P1>P3>P2" means that the minimum values of the respective pressures are compared.

Here, the pressure P1 of the regenerator material 270A, the pressure P2 of the regenerator material 270B and the pressure P3 of the regenerator material 270C are selected such that the specific heats of the helium gas in the containers 265A, 265B and 265C are great in the corresponding temperature ranges to which the containers 265A, 265B and 265C are exposed.

Figure 10:
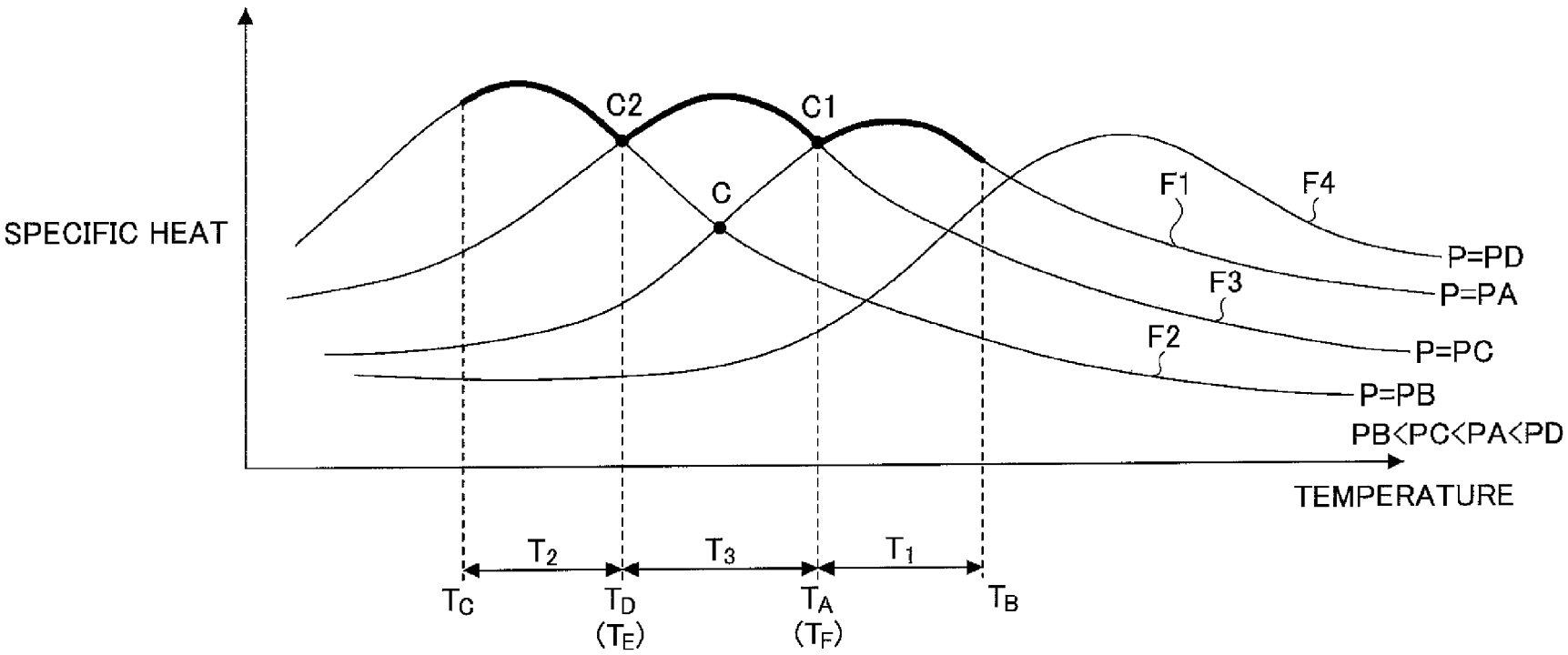
FIG. 10 is a diagram for explaining a concept in determining a pressure of a regenerator material in the regenerator.

In the following, this idea is explained in detail with reference to FIG. 10. FIG. 10 is a diagram for explaining a concept in determining the pressures P1, P2 and P3 of the regenerator materials 270A, 270B and 270C according to the embodiment. In FIG. 10, a lateral axis indicates a temperature (in unit K) and a vertical axis indicates a specific heat of the regenerator material (in unit J/(cc K)).

First of all, it is assumed that the first container 265A is disposed in a portion in the regenerator 200 which has a temperature region T1. Here, the temperature region T1 is between the lowest temperature TA and the highest temperature TB. In this case, the pressure P1 of the regenerator material 270A in the first container 265A is selected such that the specific heat becomes maximum in the temperature region T1. For example, in the case of the example illustrated in FIG. 10, the pressure, at which the peak of the specific heat of the helium gas appears in the temperature region T1, that is to say, the pressure PA, which has a change characteristic of specific heat vs. temperature indicated by F1, is selected as the pressure P1 of the regenerator material 270A. With this arrangement, the helium gas, which has the pressure at which the specific heat becomes high and an appropriate cold accumulating capability is obtained, can be selected as the regenerator material 270A of the first container 265.

Next, it is assumed that the second container 265B is disposed in a portion in the regenerator 200 which has a temperature region T2. Here, the temperature region T2 is between the lowest temperature TC and the highest temperature TD. Further, TC is less than TA and TD is less than TB. It is noted that in the example illustrated in FIG. 10, it is assumed that TD is less than TA.

The pressure P2 of the regenerator material 270B in the second container 265B is selected such that the specific heat becomes maximum in the temperature region T2. For example, in the case of the example illustrated in FIG. 10, the pressure, at which the peak of the specific heat of the helium gas appears in the temperature region T2, that is to say, the pressure PB, which has a change characteristic of specific heat vs. temperature indicated by F2, is selected as the pressure P2 of the regenerator material 270B. With this arrangement, the helium gas, which has the pressure at which the specific heat becomes high and an appropriate cold accumulating capability is obtained, can be selected as the regenerator material 270B of the second container 265B.

Next, it is assumed that the third container 265C is disposed in a portion in the regenerator 200 which has a temperature region T3. Here, the temperature region T3 is between the lowest temperature TE and the highest temperature TF. TE is less than TA and TF is less than TB. Further, TE is greater than TC and TF is greater than TD. It is noted that in the example illustrated in FIG. 10 it is assumed that TE is equal to TD and TF is equal to TA; however, the relationships between TD and TE and between TF and TA are not limited to this. For example, TE may be less than TD, and TF may be greater than TA.

The pressure P3 of the regenerator material 270C in the third container 265C is selected such that the specific heat becomes maximum in the temperature region T3. For example, in the case of the example illustrated in FIG. 10, the pressure, at which the peak of the specific heat of the helium gas appears in the temperature region T3, that is to say, the pressure PC, which has a change characteristic of specific heat vs. temperature indicated by F3, is selected as the pressure P3 of the regenerator material 270C. With this arrangement, the helium gas, which has the pressure at which the specific heat becomes high and an appropriate cold accumulating capability is obtained, can be selected as the regenerator material 270C of the third container 265C.

Thus, it is possible to provide the regenerator material with an appropriate cold accumulating capability over a whole temperature range of the regenerator 200 between TC and TB.

It is noted that the wider the temperature regions T1, T2 and T3 are, the wider option of the pressures of the helium gas to be selected becomes. Specifically, the pressure at which the specific heat becomes maximum can have a certain range. Thus, in fact, the pressure P1 of the regenerator material 270A may be selected from the range of the pressure in which the specific heat becomes maximum. Similarly, the pressure P2 of the regenerator material 270B and the pressure P3 of the regenerator material 270C may be selected from the range of the pressure in which the specific heat becomes maximum.

Here, if it is assumed that the minimum temperature to which the first container 265A is exposed is TA and a range (i.e., a range between TA and TF) of the highest temperature TF to which the third container 265C is exposed is a temperature range TP1, it is preferred that a change characteristic curve (F3, for example) of specific heat vs. temperature at the pressure (PC, for example) selected as the pressure P3 of the regenerator material 270C and a change characteristic curve (F1, for example) of specific heat vs. temperature at the pressure (PA, for example) selected as the pressure P1 of the regenerator material 270A have an intersection in the temperature range TP1.

Further, if it is assumed that the minimum temperature to which the second container 265B is exposed is TD and a range (i.e., a range between TD and TE) of the highest temperature TE to which the third container 265C is exposed is a temperature range TP2, it is preferred that a change characteristic curve (F2, for example) of specific heat vs. temperature at the pressure (PB, for example) selected as the pressure P2 of the regenerator material 170B and a change characteristic curve (F3, for example) of specific heat vs. temperature at the pressure (PC, for example) selected as the pressure P3 of the regenerator material 270C have an intersection in the temperature range TP2.

For example, in the example illustrated in FIG. 10, the change characteristic curve F1 of specific heat vs. temperature at the pressure PA and the change characteristic curve F3 of specific heat vs. temperature at the pressure PC intersect at a point C1 at the temperature TA (TF). Further, the change characteristic curve F2 of specific heat vs. temperature at the pressure PB and the change characteristic curve F3 of specific heat vs. temperature at the pressure PC intersect at a point C2 at the temperature TD (TE).

With this arrangement, the influence of the temperature change on the specific heat of the regenerator material can be reduced with increased reliability.

In particular, according to the second embodiment, in comparison with the first embodiment, the respective containers have the regenerator materials accommodated therein at such pressures that the specific heats are increased in the corresponding temperature regions to which the respective containers are exposed. Thus, according to the second embodiment, the influence of the change in the specific heat due to the temperature change is reduced, and thus the regenerator with more stable cold accumulating capability can be configured.

It is noted that, as is apparent from the foregoing, the number of the containers accommodating the regenerator materials is arbitrary as long as it is greater than or equal to 2. In particular, the greater the number of the containers is, the more gradually the pressure of the regenerator material accommodated in the containers can be changed according to the temperature regions to which the containers are exposed. Thus, the more the number of the containers is, the less the influence of the change in the specific heat due to the temperature change becomes, and thus the more stable cold accumulating capability the regenerator can be configured to have.

It is noted that if it is assumed that the regenerator 200 according to the embodiment is provided in the second stage displacer 52 of the GM refrigerator 1 illustrated in FIG. 2, it is preferred that the first container 265A is disposed in a temperature region greater than or equal to about 6 K, and the pressure P1 of the regenerator material 270A is preferably greater than or equal to 0.8 MPa and less than or equal to 3.5 MPa, and more preferably greater than or equal to 1.5 MPa and less than or equal to 2.2 MPa. Further, it is preferred that the third container 165C is disposed in a temperature region between about 4 K and about 10 K, and the pressure P3 of the regenerator material 270C is preferably between 0.8 MPa and 2.2 MPa, and more preferably greater than or equal to 0.8 MPa and less than or equal to 1.5 MPa. Further, it is preferred that the second container 265B is disposed in a temperature region less than or equal to about 10 K, and the pressure P2 of the regenerator material 270B is preferably greater than or equal to 0.1 MPa and less than or equal to 2.2 MPa, and more preferably greater than or equal to 0.4 MPa and less than or equal to 1.5 MPa.

Third Embodiment

Figure 11:
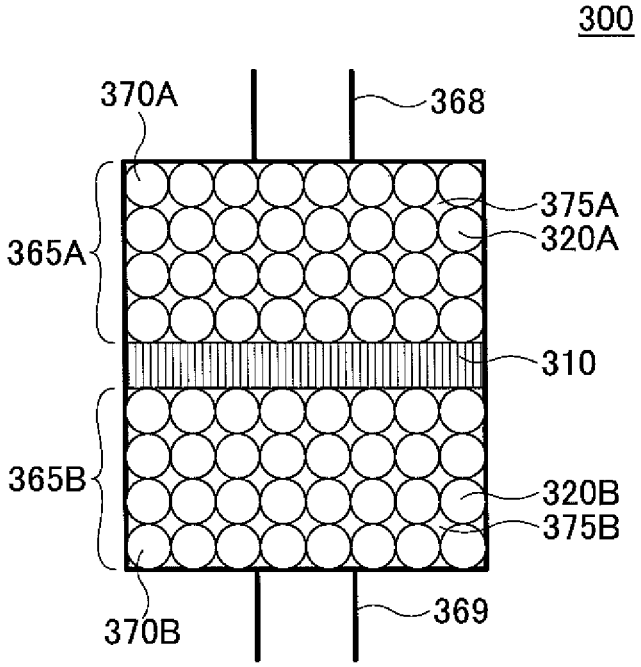
FIG. 11 is a cross-sectional view for schematically illustrating yet another example of helium-cooling type regenerator according to the embodiment.

FIG. 11 is a cross-sectional view for schematically illustrating an example of a helium-cooling type regenerator according to the third embodiment.

The regenerator 300 includes a first working gas channel 368 and a second working gas channel 369, as illustrated in FIG. 11. Further, the regenerator 300 has a first section 365A and a second section 365B therein separated by a separating member 310.

The separating member 310 has a function of separating the two sections and preventing thermal conductive capsules 320A and 320B described hereinafter from mixing with each other. The separating member 310 is made of a metal mesh or the like, for example.

The first section 365A is provided on the warm side of the regenerator 300 (on an upper side of the regenerator 300 in the example illustrated in FIG. 11), and the second section 365B is provided on the cold side of the regenerator 300 (on a lower side of the regenerator 300 in the example illustrated in FIG. 11). The first section 365A has plural thermal conductive capsules 320A accommodated therein, and a space 375A is formed in which there are no thermal conductive capsules 320A. The second section 365B has plural thermal conductive capsules 320B accommodated therein, and a space 375B is formed in which there are no thermal conductive capsules 320B.

The thermal conductive capsules 320A are filled with helium gas as a regenerator material 370A. The pressure of the regenerator material 370A is P1. The thermal conductive capsules 320B are filled with helium gas as a regenerator material 370B. The pressure of the regenerator material 370B is P2, and P1 is greater than P2.

The thermal conductive capsules 320A and 320B may be formed of a copper, a copper alloy, a stainless steel, or the like, for example. The thickness of the thermal conductive capsules 320A and 320B is between 0.05 mm and 2 mm, for example. For example, the thickness may be 1 mm. The thermal conductive capsules 320A and 320B may have arbitrary shape such as a spherical shape and a flattened spherical shape. In the example illustrated in FIG. 11, the thermal conductive capsules 320A and 320B have a spherical shape whose diameter is between 0.1 mm and 2 mm, for example. It is noted that the shapes, dimensions, etc., of the thermal conductive capsules 320A may be the same or different. Similarly, the shapes, dimensions, etc., of the thermal conductive capsules 320B may be the same or different.

The working gas passes through the space 375A and the space 375B via the first working gas channel 368 and the second working gas channel 369. Thus, the separating member 310 has holes penetrated therethrough such that the working gas flows through the space 375A and the space 375B.

Here, the pressure P1 of the regenerator material 370A and the pressure P2 of the regenerator material 370B are selected such that the specific heats of the helium gas in the thermal conductive capsules 320A and 320B are great in the corresponding temperature regions to which the thermal conductive capsules 320A and 320B are exposed.

It is noted the selecting method of the pressure P1 and the pressure P2 may be as described above.

It is apparent to those skilled in the art that the regenerator 300 according to the third embodiment described above has the same effects as the embodiments described above.

It is noted that also in the third embodiment the regenerator 300 may have more than or equal to three sections divided in the temperature gradient direction. In this case, by adjusting the pressures of the regenerator materials in the thermal conductive capsules disposed in the respective sections, the regenerator can be obtained which has the reduced influence of the reduction in the specific heat due to the temperature change of the regenerator materials.

Fourth Embodiment

Figure 12:
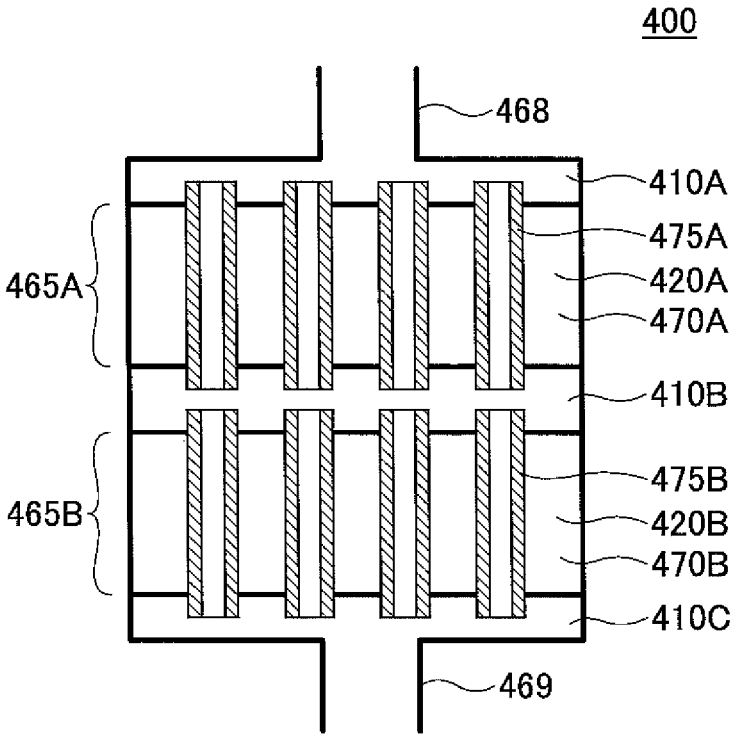
FIG. 12 is a cross-sectional view for schematically illustrating yet another example of a helium-cooling type regenerator according to the embodiment.

FIG. 12 is a cross-sectional view for schematically illustrating an example of a helium-cooling type regenerator according to the fourth embodiment.

The regenerator 400 includes a first working gas channel 468 and a second working gas channel 469, as illustrated in FIG. 12. Further, the regenerator 400 has a first section 465A and a second section 465B therein separated by a separating member 410B.

The first section 465A is provided on the warm side of the regenerator 400 (on an upper side of the regenerator 400 in the example illustrated in FIG. 12), and the second section 465B is provided on the cold side of the regenerator 400 (on a lower side of the regenerator 400 in the example illustrated in FIG. 12). The first section 465A has plural hollow tubes 475A which are arranged such that they are supported by a flange 410A and the separating member 410B. A storage part 420A for accommodating the helium gas as a regenerator material 470A is formed in which there are no hollow tubes 475A. The working gas flows through the hollow tubes 475A. Thus, the first working gas channel 468 is in fluid communication with the inside of the hollow tubes 475A.

The second section 465B has plural hollow tubes 475B which are arranged such that they are supported by a flange 410C and the separating member 410B. A storage part 420B for accommodating the helium gas as a regenerator material 470B is formed in which there are no hollow tubes 475B. The working gas flows through the hollow tubes 475B. Thus, the second working gas channel 469 is in fluid communication with the inside of the hollow tubes 475B.

The hollow tubes 475A and 475B may be formed of a copper, a copper alloy, a stainless steel, or the like, for example. The hollow tubes 475A and 475B may have arbitrary cross-sectional shapes such as a spherical shape and an ellipse shape, as long as they have tube-like configurations. It is noted that the shapes, dimensions, etc., of the hollow tubes 475A may be the same or different. Similarly, the shapes, dimensions, etc., of the hollow tubes 475B may be the same or different.

The separating member 410B has a function of providing a communicating path between the hollow tubes 475A and the hollow tubes 475B. Further, the separating member 410B has a function of preventing the regenerator material 470A accommodated in the storage part 420A and the regenerator material 470B accommodated in the storage part 420B from mixing with each other. It is noted that the working gas and the regenerator materials 470A and 470B are separated by the hollow tubes 475A and 475B and the flanges 410A and 410C.

The high-pressure working gas is introduced into the regenerator 400 via the first working gas channel 468. Next, the working gas in the first section 465A flows through the hollow tubes 475A and the communication path formed in the separating member 410B. Further, the working gas flows through the hollow tubes 475B provided in the second section 465B, and then is ejected from the regenerator 400 via the second working gas channel 469.

On the other hand, the low-pressure working gas is introduced to the regenerator 400 and ejected from the regenerator 400 along a reversed flow path.

The regenerator material 470A accommodated in the storage part 420A has the pressure P1 and the regenerator material 470B accommodated in the storage part 420B has the pressure P2, where P1 is greater than P2.

Here, the pressure P1 of the regenerator material 470A and the pressure P2 of the regenerator material 470B are selected such that the specific heats of the helium gas in the storage parts 420A and 420B are great in the corresponding temperature regions to which the storage parts 420A and 420B are exposed.

It is noted the selecting method of the pressure P1 and the pressure P2 may be as described above.

It is apparent to those skilled in the art that the regenerator 400 according to the fourth embodiment described above has the same effects as the embodiments described above.

It is noted that also in the fourth embodiment the regenerator 400 may have more than or equal to three sections 465A, 465B, 465C, etc., divided in the temperature gradient direction. In this case, by adjusting the pressures of the regenerator materials in the storage parts 420A, 420B, 420C, etc., formed in the respective sections, the regenerator can be obtained which has the reduced influence of the reduction in the specific heat due to the temperature change of the regenerator materials.

Fifth Embodiment

Figure 13:
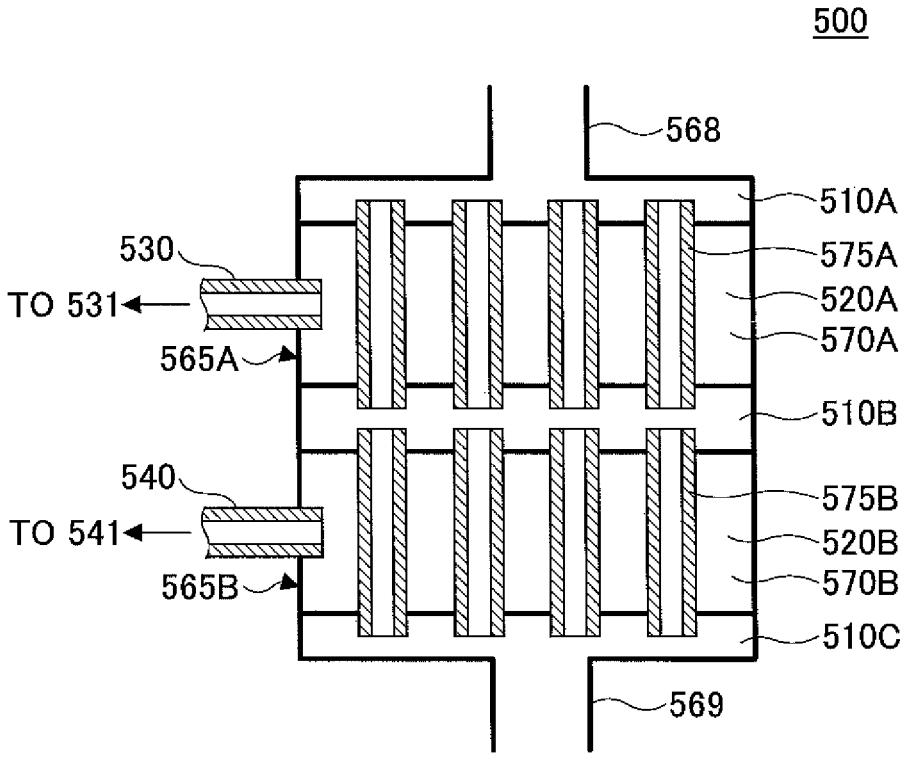
FIG. 13 is a cross-sectional view for schematically illustrating yet another example of a helium-cooling type regenerator according to the embodiment.

FIG. 13 is a cross-sectional view for schematically illustrating an example of a helium-cooling type regenerator according to the fifth embodiment.

As illustrated in FIG. 13, the regenerator 500 includes the same elements as the regenerator 400 described above and illustrated in FIG. 12. Thus, in FIG. 13, the same elements as illustrated in FIG. 12 are indicated by reference numbers which are obtained by adding 100 to the corresponding reference numbers in FIG. 12.

However, the regenerator 500 differs from the regenerator 400 illustrated in FIG. 12 in that it additionally includes a first regenerator material flow pipe 530 and a second regenerator material flow pipe 540.

The first regenerator material flow pipe 530 has one end connected to a storage part 520A provided in a first section 565A on a warm side. The first regenerator material flow pipe 530 has another end (not illustrated) connected to a high-pressure helium gas source 531.

The second regenerator material flow pipe 540 has one end connected to a storage part 520B provided in a second section 565B on a warm side.

The second regenerator material flow pipe 540 has another end (not illustrated) connected to a low-pressure helium gas source 541.

It is noted that the "helium gas source" includes any parts in which helium gas and/or liquid helium is stored. For example, if the regenerator is used for a cold accumulation tube of the GM refrigerator, the helium source may be a compressor for supplying and exhausting the working gas. Further, if the regenerator is used for a cold accumulation tube of the pulse tube refrigerator, the helium source may be a compressor for supplying and exhausting the working gas, and/or a buffer tank connected to the pulse tube, etc.

A regenerator material 570A and a regenerator material 570B are separated by a separating member 510B and thus they are not mixed. The working gas and the regenerator materials 570A and 570B are separated by hollow tubes 575A and 5753 and flanges 510A and 510C and thus they are not mixed.

According to the regenerator 400 illustrated in FIG. 12, the regenerator materials are accommodated in the storage parts 420A and 4203 in advance. In contrast, according the regenerator 500 illustrated in FIG. 13, the regenerator material 570A accommodated in the storage part 520A in the first section 565A is supplied from the high-pressure helium gas source 531 via the first regenerator material flow pipe 530 during an operation of the regenerator. Further, the regenerator material 570B accommodated in the storage part 520B in the second section 565B is supplied from the low-pressure helium gas source 541 via the second regenerator material flow pipe 540 during an operation of the regenerator.

Thus, the effects according to the embodiments described above can be obtained by setting the pressure of the helium gas supplied to the storage part 520A in the first section 565A from the high-pressure helium gas source 531 such that it becomes 21 during the operation of the regenerator, and setting the pressure of the helium gas supplied to the storage part 520B in the second section 565B from the low-pressure helium gas source 541 such that it becomes P2 during the operation of the regenerator. It is noted that the values of the pressures P1 and 22 may be set as described above.

Sixth Embodiment

Figure 14:
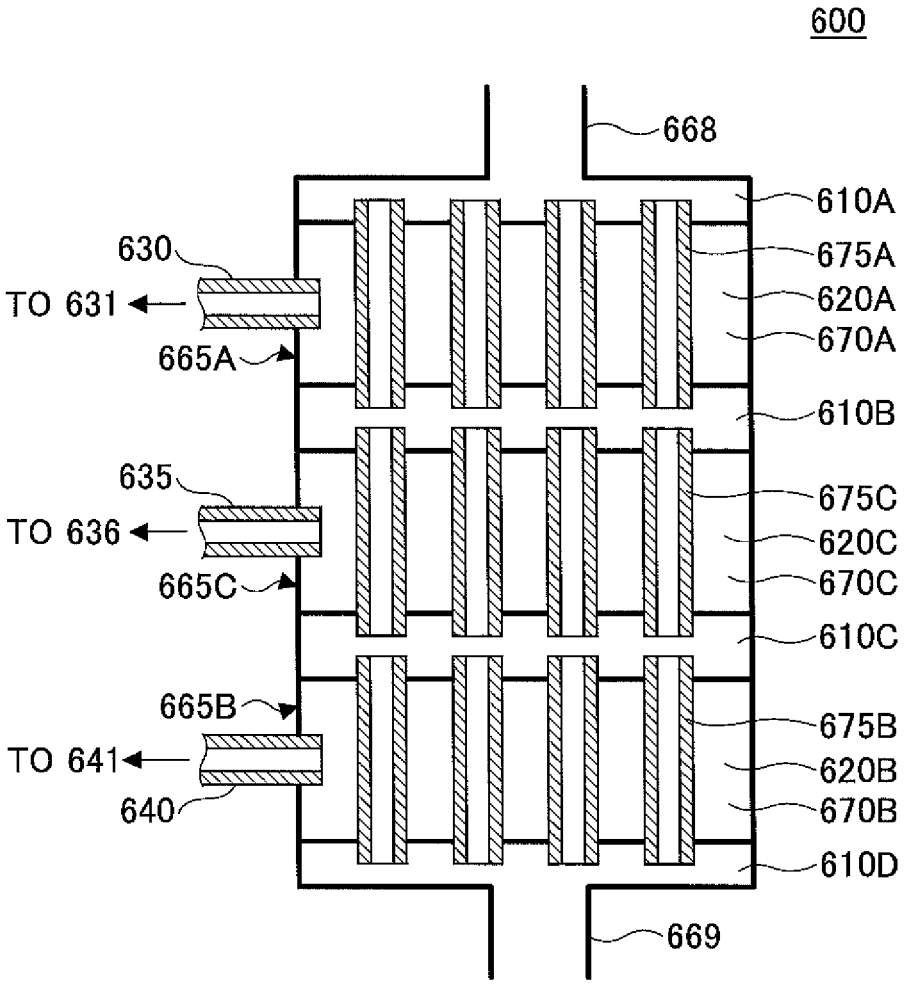
FIG. 14 is a cross-sectional view for schematically illustrating yet another example of a helium-cooling type regenerator according to the embodiment.

FIG. 14 is a cross-sectional view for schematically illustrating an example of a helium-cooling type regenerator according to the sixth embodiment.

As illustrated in FIG. 14, the regenerator 600 includes the same elements as the regenerator 500 described above and illustrated in FIG. 13. Thus, in FIG. 14, the same elements as illustrated in FIG. 13 are indicated by reference numbers which are obtained by adding 100 to the corresponding reference numbers in FIG. 13.

The regenerator 600 further includes a third section 665C between a first section 665A and a second section 665B. The third section 665C is provided on an intermediate temperature side of the regenerator 600. The third section 6650 is separated from the first section 665A on the warm side by a separating member 610E and is separated from the second section 665B on the cold side by a separating member 610C.

The third section 665C has plural hollow tubes 675C which are arranged such that they are supported by the separating member 610B and the separating member 610C. A storage part 620C for accommodating the helium gas as a regenerator material 670C is formed in which there are no hollow tubes 675C. The working gas flows through the hollow tubes 675C. The separating member 610B has a function of providing fluid communication between the hollow tubes 675A and the hollow tubes 675C, and the separating member 610B has a function of providing a fluid communication between the hollow tubes 675C and the hollow tubes 675B.

Further, the third section 665C is connected to one end of a third regenerator material flow pipe 635, and the third regenerator material flow pipe 635 is in fluid communication with a storage part 620C. The third regenerator material flow pipe 635 has another end (not illustrated) connected to an intermediate-pressure helium gas source 636.

Further, the regenerator material 670C accommodated in the storage part 620C in the third section 665C is supplied from the intermediate-pressure helium gas source 636 via the third regenerator material flow pipe 635 during the operation of the regenerator 600.

The pressure of the helium gas supplied to the storage part 620A in the first section 665A from the high-pressure helium gas source 631 is set such that it becomes P1 during the operation of the regenerator 600, the pressure of the helium gas supplied to the storage part 620B in the second section 665B from the low-pressure helium gas source 641 such that it becomes P2 during the operation of the regenerator 600, and the pressure of the helium gas supplied to the storage part 620C in the third section 665C from the intermediate-pressure helium gas source 636 such that it becomes P3 during the operation of the regenerator 600. It is noted that the values of the pressures P1, P2 and P3 may be set as described above.

According to the regenerator 600, the cold accumulating capability becomes more stable in comparison with the regenerator 500 illustrated in FIG. 13.

In the foregoing, configurations and effects obtained by them are described with respect to a case where only the helium gas with different pressures is used as the regenerator material of the regenerator. However, in the embodiments, the regenerator may include plural regenerator materials. For example, with respect to one regenerator, the $HoCu_2$ magnetic material may be used on the highest temperature side, and a magnetic material such as $GdO_2S_2$ may be used on the lowest temperature side. In this case, regenerator parts such as the storage spaces described above, in which helium gas with different pressures are accommodated, may be provided in an intermediate temperature region to be a part of the whole regenerator.

Refrigerator Including Regenerator According to the Embodiments

The regenerator according to the embodiments can be applied to various cold accumulation refrigerators such as a GM refrigerator, a pulse tube refrigerator, etc. Next, a pulse tube refrigerator to which the regenerator according to the embodiment is applied is briefly described.

[Pulse Tube Refrigerator 1]

Figure 15:
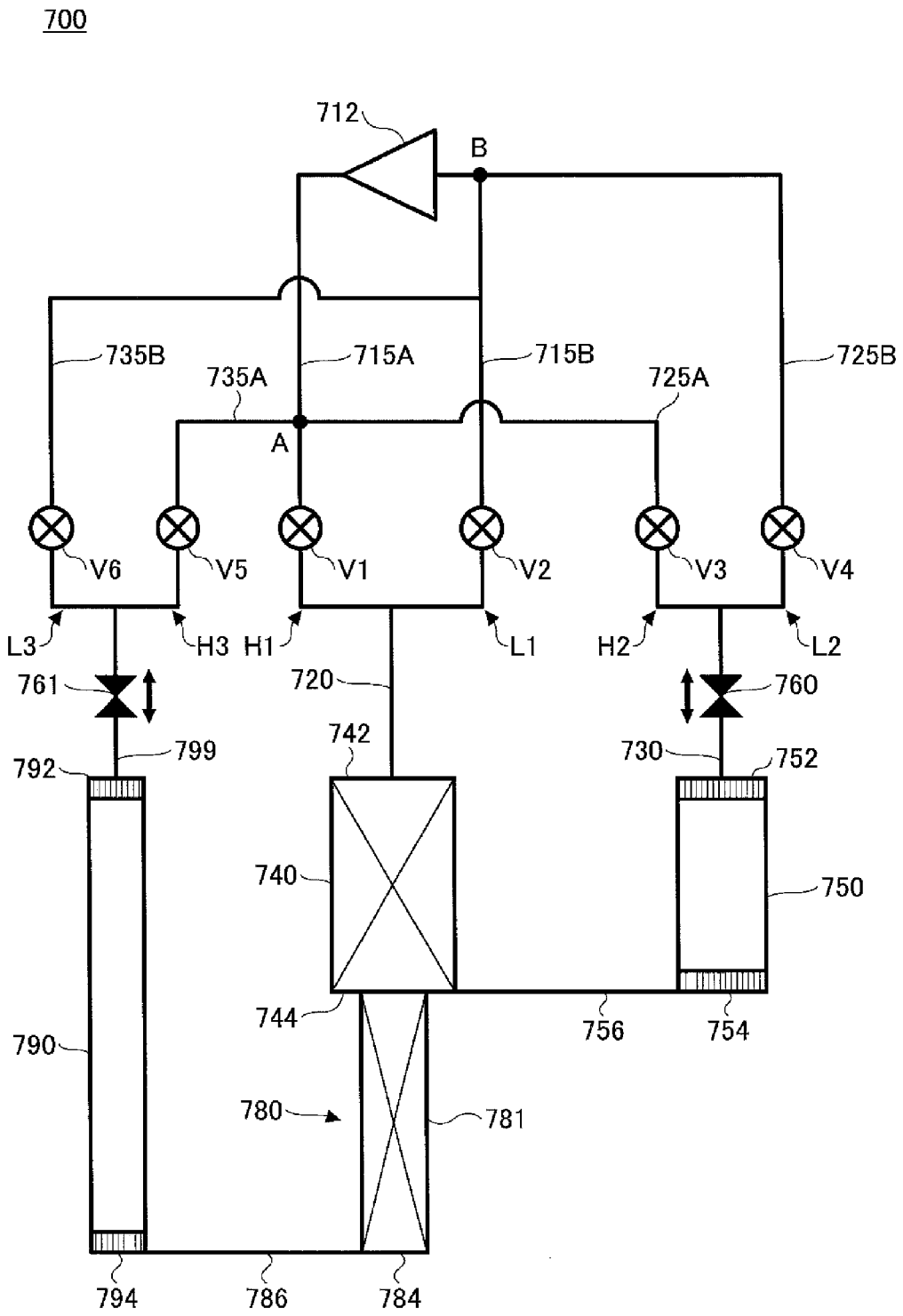
FIG. 15 is a diagram for schematically illustrating an example of a configuration of a pulse tube refrigerator including the regenerator according to the embodiment.

FIG. 15 is a diagram for schematically illustrating an example of a configuration of a pulse tube refrigerator including the regenerator according to the embodiment.

As illustrated in FIG. 15, the pulse tube refrigerator 700 is of a two-stage type.

The pulse tube refrigerator 700 includes a compressor 712, a first stage cold accumulation tube 740, a second stage cold accumulation tube 780, a first stage pulse tube 750, a second stage pulse tube 790, first and second pipes 756 and 786, orifices 760 and 761, opening/closing valves V1 through V6, etc.

The first stage cold accumulation tube 740 includes a warm end 742 and a cold end 744, and the second stage cold accumulation tube 780 includes a warm end 744 (corresponding to the cold end 744 of the first stage cold accumulation tube 740) and a cold end 784. The first stage pulse tube 750 includes a warm end 752 and a cold end 754, and the second stage pulse tube 790 includes a warm end 792 and a cold end 794. Heat exchangers are provided at the respective warm ends 752 and 792 and cold ends 754 and 794. The cold end 744 of the first stage cold accumulation tube 740 is connected to the cold end 754 of the first stage pulse tube 750 via the first pipe 756. Further, the cold end 784 of the second stage cold accumulation tube 780 is connected to the cold end 794 of the second stage pulse tube 790 via the second pipe 786.

A refrigerant flow channel at the high-pressure side (discharge side) of the compressor 712 is branched at a point A into three directions to form first, second and third refrigerant supply channels H1 through H3. The first refrigerant supply channel H1 connects the high-pressure side of the compressor 712, a first high-pressure side pipe 715A in which the opening/closing valve V1 is provided, a common pipe 720 and the first stage cold accumulation tube 740. The second refrigerant supply channel H2 connects the high-pressure side of the compressor 712, a second high-pressure side pipe 725A in which the opening/closing valve V3 is provided, a common pipe 730 in which the orifice 760 is provided, and the first stage pulse tube 750. The third refrigerant supply channel H3 connects the high-pressure side of the compressor 712, a third high-pressure side pipe 735A in which the opening/closing valve V5 is provided, a common pipe 799 in which the orifice 761 is provided, and the second stage pulse tube 790.

On the other hand, a refrigerant flow channel at the low-pressure side (inlet side) of the compressor 712 is branched into three directions to form first, second and third refrigerant return channels L1 through L3. The first refrigerant return channel L1 connects the first stage cold accumulation tube 740, the common pipe 720, a first low-pressure side pipe 715B in which the opening/closing valve V2 is provided, a point B and the compressor 712. The second refrigerant return channel L2 connects the first stage pulse tube 750, the common pipe 730 in which the orifice 760 is provided, a second low-pressure side pipe 725B in which the opening/closing valve V4 is provided, the point B and the compressor 712. The third refrigerant return channel L3 connects the second stage pulse tube 790, the common pipe 799 in which the orifice 761 is provided, a third low-pressure side pipe 735B in which the opening/closing valve V6 is provided, the point B and the compressor 712.

It is noted that general operations of the pulse tube refrigerator 700 with the configuration as described above are well-known to those skilled in the art, and thus are not explained.

The second stage cold accumulation tube 780 includes a regenerator 781 which has features described above. For example, if the regenerator 781 is the regenerator 100 illustrated in FIG. 5, the temperature to which the second container 165B on the cold side is exposed is between about 4 K and about 6 K, for example, and the temperature to which the first container 165A on the warm side is exposed is between about 6 K and about 8 K, for example. Further, the pressure P2 is less than 0.4 MPa, for example, and the pressure P1 is between about 0.4 MPa and about 0.8 MPa.

With this arrangement, during the operation of the pulse tube refrigerator 700, the change in the specific heat of the regenerator material due to the temperature change is substantially reduced in the regenerator 781 in the second stage cold accumulation tube 780. Thus, a stable cold accumulating capability can be maintained in the second stage cold accumulation tube 780 of the pulse tube refrigerator 700.

[Pulse Tube Refrigerator 2]

Figure 16:
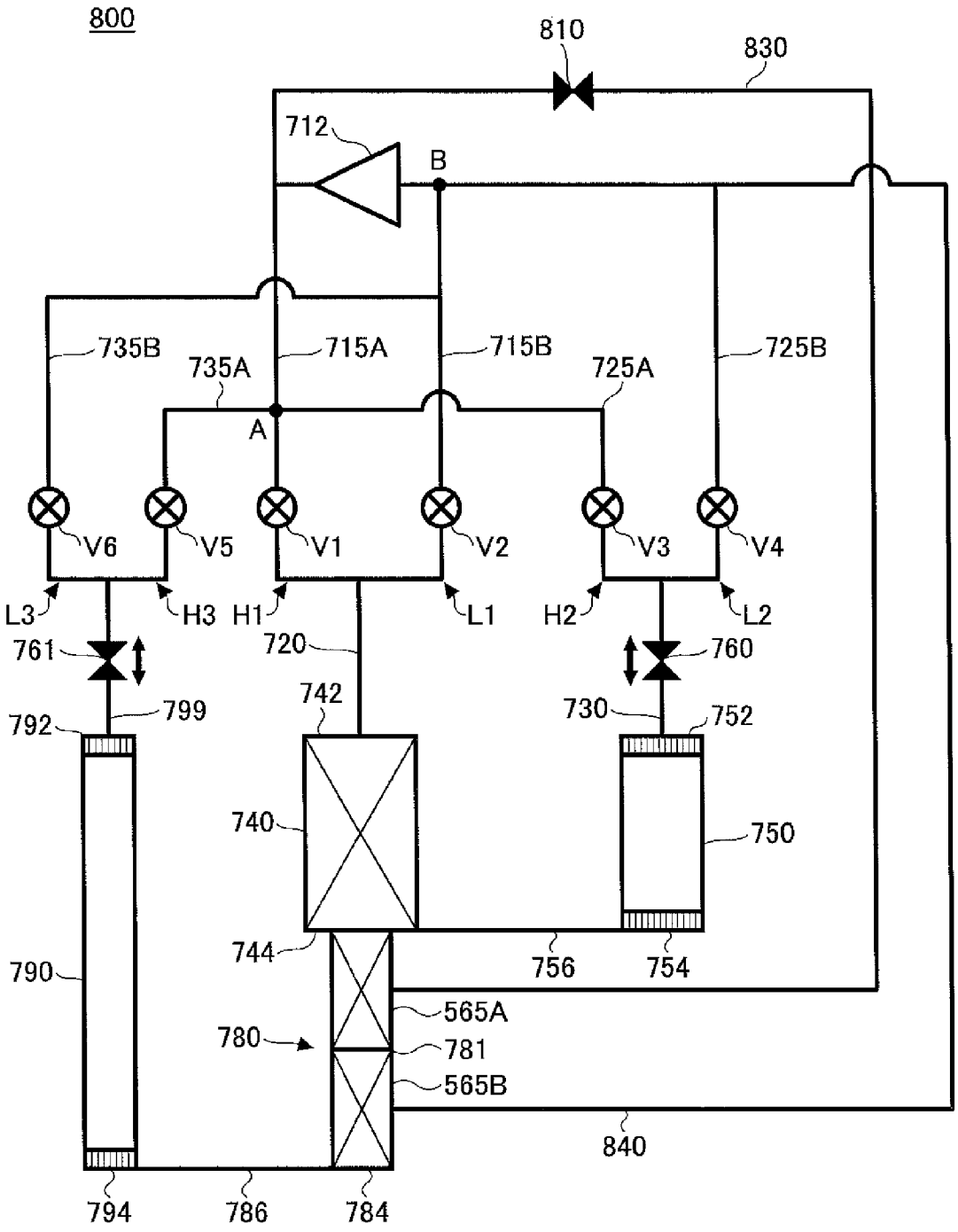
FIG. 16 is a diagram for schematically illustrating another example of a configuration of a pulse tube refrigerator including the regenerator according to the embodiment.

FIG. 16 is a diagram for schematically illustrating another example of a configuration of a pulse tube refrigerator including the regenerator according to the embodiment.

As illustrated in FIG. 16, the pulse tube refrigerator 800 includes the same elements as the pulse tube refrigerator 700 described above. Thus, with respect to the pulse tube refrigerator 800, the same elements as the pulse tube refrigerator 700 illustrated in FIG. 15 are indicated by the same reference numbers in FIG. 15.

However, the pulse tube refrigerator 800 further includes a first regenerator material flow pipe 830 and a second regenerator material flow pipe 840. A flow resistance 810 such as an orifice is provided in the first regenerator material flow pipe 830. However, the flow resistance 810 may be omitted.

The first regenerator material flow pipe 830 has one end connected to the high-pressure side of the compressor 712 and another end connected to the regenerator 781 in the second stage cold accumulation tube 780. More specifically, the other end of the first regenerator material flow pipe 830 is connected to a storage part 520A which is provided in the first section 565A on the warm side of the regenerator 781 for accommodating the regenerator material at the pressure P1. On the other hand, the second regenerator material flow pipe 840 has one end connected to the low-pressure side of the compressor 712 and another end connected to the regenerator 781 in the second stage cold accumulation tube 780. More specifically, the other end of the second regenerator material flow pipe 840 is connected to a storage part 520B which is provided in the second section 565B on the cold side of the regenerator 781 for accommodating the regenerator material at the pressure 22.

In this case, the regenerator 781 has the same configuration as the regenerator 500 as described above and illustrated in FIG. 13, and "the high-pressure helium gas source" and "the low-pressure helium gas source" correspond to the high-pressure side (discharge side) and the low-pressure side (inlet side) of the compressor 712, respectively.

With the pulse tube refrigerator 800 configured as described above, the change in the specific heat of the regenerator material due to the temperature change is substantially reduced in the regenerator 781 in the second stage cold accumulation tube 780. Thus, a stable cold accumulating capability can be maintained in the second stage cold accumulation tube 780 of the pulse tube refrigerator 800.

It is noted that the first regenerator material flow pipe 830 may have a control valve and a pressure measuring part (not illustrated) at any place. In this case, by controlling the degree of opening of the control valve based on a value of the pressure in the first regenerator material flow pipe 830 measured by the pressure measuring part, the pressure of the high-pressure helium gas in the first regenerator material flow pipe 830 can be adjusted to a desired value. In addition to this or instead of this, the second regenerator material flow pipe 840 may have a control valve and a pressure measuring part at any place. With this arrangement, the pressure of the low-pressure helium gas in the second regenerator material flow pipe 840 can be adjusted to a desired value.

The compressor 712 has a bypass relief valve if the compressor 712 is of an ordinary type. Thus, if the pressures in the storage part 520A of the first section 565A of the regenerator 780 and the first regenerator material flow pipe 830 are high at the time of stopping the pulse tube refrigerator 800, the bypass relief valve in the compressor 712 is operated such that the regenerator material flows from the high-pressure side to the low-pressure side. For this reason, with the configuration described above, it is not necessary to provide a new member in the regenerator 780 for releasing the high-pressure regenerator material.

[Pulse Tube Refrigerator 3]

Figure 17:
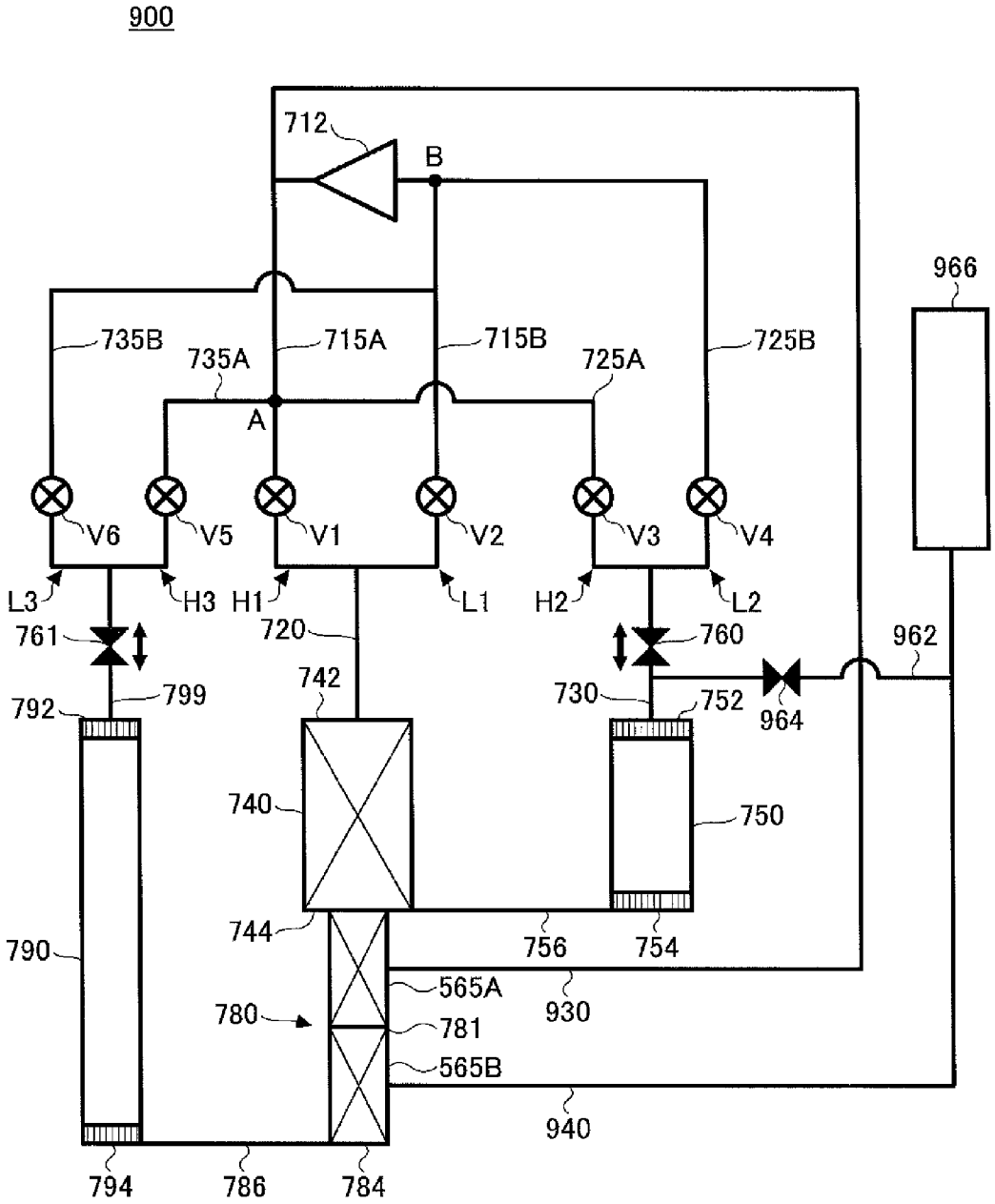
FIG. 17 is a diagram for schematically illustrating yet another example of a configuration of a pulse tube refrigerator including the regenerator according to the embodiment.

FIG. 17 is a diagram for schematically illustrating another example of a configuration of a pulse tube refrigerator including the regenerator according to the embodiment.

As illustrated in FIG. 17, the pulse tube refrigerator 900 includes the same elements as the pulse tube refrigerator 700 illustrated in FIG. 15. Thus, with respect to the pulse tube refrigerator 900, the same elements as the pulse tube refrigerator 700 illustrated in FIG. 15 are indicated by the same reference numbers in FIG. 15.

However, the pulse tube refrigerator 900 further includes a buffer tank 966, a first regenerator material flow pipe 930 and a second regenerator material flow pipe 940.

The buffer tank 966 is connected to the warm end 732 of the first stage pulse tube 730 via a pipe 962 in which an orifice 964 is provided.

The first regenerator material flow pipe 930 has one end connected to the high-pressure side of the compressor 712 and another end connected to the regenerator 781 in the second stage cold accumulation tube 780. More specifically, the other end of the first regenerator material flow pipe 930 is connected to a storage part 520A which is provided in the first section 565A on the warm side of the regenerator 781 for accommodating the regenerator material at the pressure P1. On the other hand, the second regenerator material flow pipe 940 has one end connected to the buffer tank 966 and another end connected to the regenerator 781 in the second stage cold accumulation tube 780. More specifically, the other end of the second regenerator material flow pipe 940 is connected to a storage part 520B which is provided in the second section 565B on the cold side of the regenerator 781 for accommodating the regenerator material at the pressure P2.

In this case, the regenerator 781 has the same configuration as the regenerator 500 as described above and illustrated in FIG. 13, and "the high-pressure helium gas source" and "the low-pressure helium gas source" correspond to the high-pressure side (discharge side) of the compressor 712 and the buffer tank 966, respectively.

It is apparent to those skilled in the art that the pulse tube refrigerator 900 described above has the same effects as the embodiments described above.

[Pulse Tube Refrigerator 4]

Figure 18:
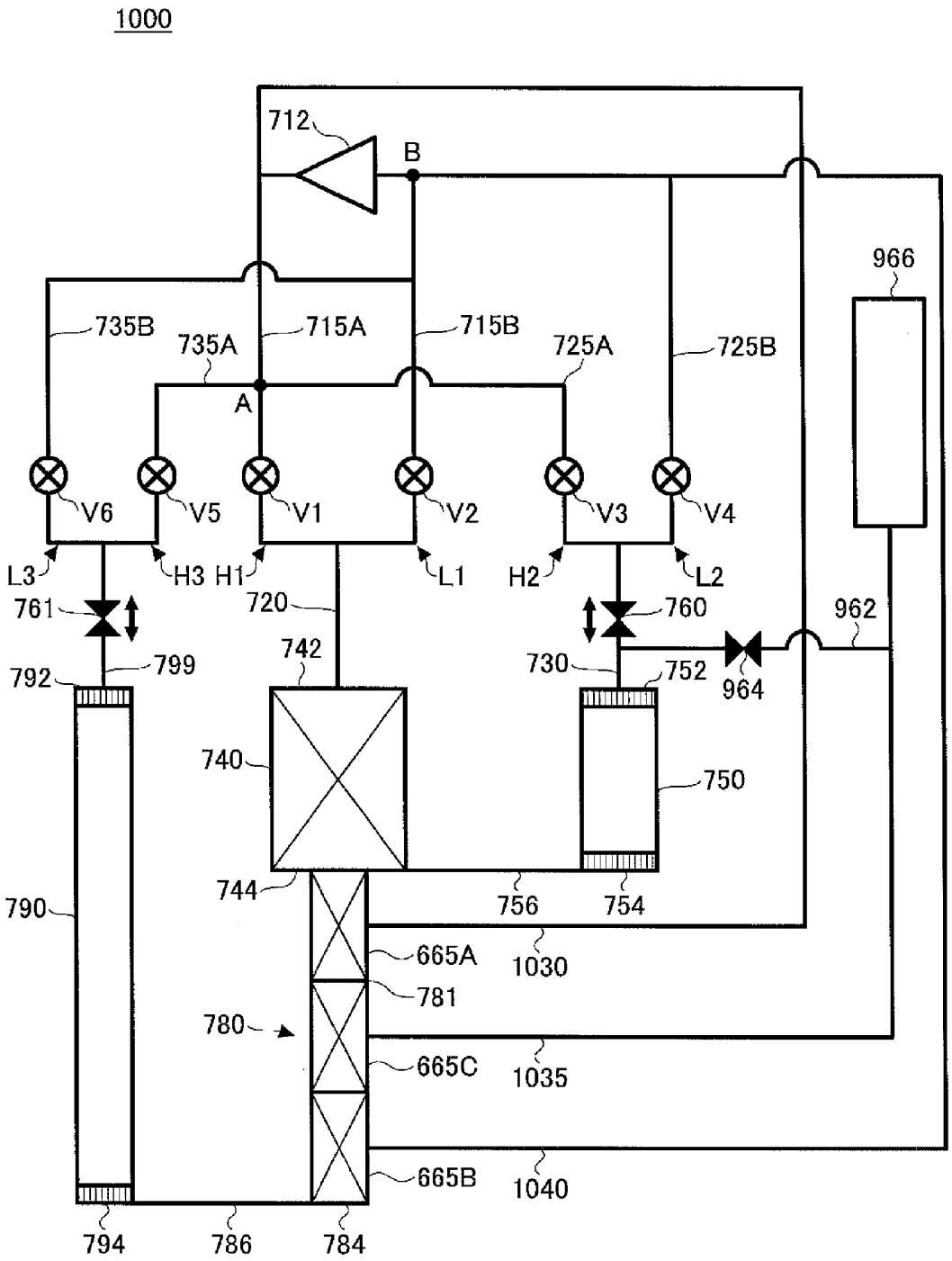
FIG. 18 is a diagram for schematically illustrating yet another example of a configuration of a pulse tube refrigerator including the regenerator according to the embodiment.

FIG. 18 is a diagram for schematically illustrating another example of a configuration of a pulse tube refrigerator including the regenerator according to the embodiment.

As illustrated in FIG. 18, the pulse tube refrigerator 1000 includes the same elements as the pulse tube refrigerator 700 illustrated in FIG. 15. Thus, with respect to the pulse tube refrigerator 1000, the same elements as the pulse tube refrigerator 700 illustrated in FIG. 15 are indicated by the same reference numbers in FIG. 15.

However, the pulse tube refrigerator 1000 further includes a buffer tank 966, a first regenerator material flow pipe 1030, a second regenerator material flow pipe 1040 and a third regenerator material flow pipe 1035.

The buffer tank 966 is connected to the warm end 752 of the first stage pulse tube 730 via a pipe 962 in which an orifice 964 is provided.

The first regenerator material flow pipe 1030 has one end connected to the high-pressure side of the compressor 712 and another end connected to the regenerator 781 in the second stage cold accumulation tube 780. More specifically, the other end of the first regenerator material flow pipe 1030 is connected to a storage part 620A which is provided in the first section 665A on the warm side of the regenerator 781 for accommodating the regenerator material at the pressure P1. On the other hand, the second regenerator material flow pipe 1040 has one end connected to the low-pressure side of the compressor 712 and another end connected to the regenerator 781 in the second stage cold accumulation tube 780. More specifically, the other end of the second regenerator material flow pipe 1040 is connected to a storage part 620B which is provided in the second section 665B on the cold side of the regenerator 781 for accommodating the regenerator material at the pressure P2. Similarly, the third regenerator material flow pipe 1035 has one end connected to the buffer tank 966 and another end connected to the regenerator 781 in the second stage cold accumulation tube 780. More specifically, the other end of the third regenerator material flow pipe 1035 is connected to a storage part 620C which is provided in the third section 665C on the intermediate temperature side of the regenerator 781 for accommodating the regenerator material at the pressure P3.

In this case, the regenerator 781 has the same configuration as the regenerator 600 as described above and illustrated in FIG. 14, and "the high-pressure helium gas source", "the low-pressure helium gas source" and "the intermediate-pressure helium gas source" correspond to the high-pressure side (discharge side) of the compressor 712, the low-pressure side (inlet side) of the compressor 712 and the buffer tank 966, respectively.

It is apparent to those skilled in the art that the pulse tube refrigerator 1000 described above has the same effects as the embodiments described above.

In the foregoing, the examples of the pulse tube refrigerator including the regenerator according to the embodiment are explained. However, it is apparent to those skilled in the art that the pulse tube refrigerator including the regenerator according to the embodiment may have other configurations. For example, according to the configuration illustrated in FIG. 17, "the high-pressure helium gas source" corresponds to the high-pressure side of the compressor 712, and "the low-pressure helium gas source" corresponds to the buffer tank 966. However, "the high-pressure helium gas source" may correspond to the buffer tank 966, and "the low-pressure helium gas source" may correspond to the low-pressure side of the compressor 712.

[GM Refrigerator]

The embodiments can be applied to the GM refrigerator.

Figure 19:
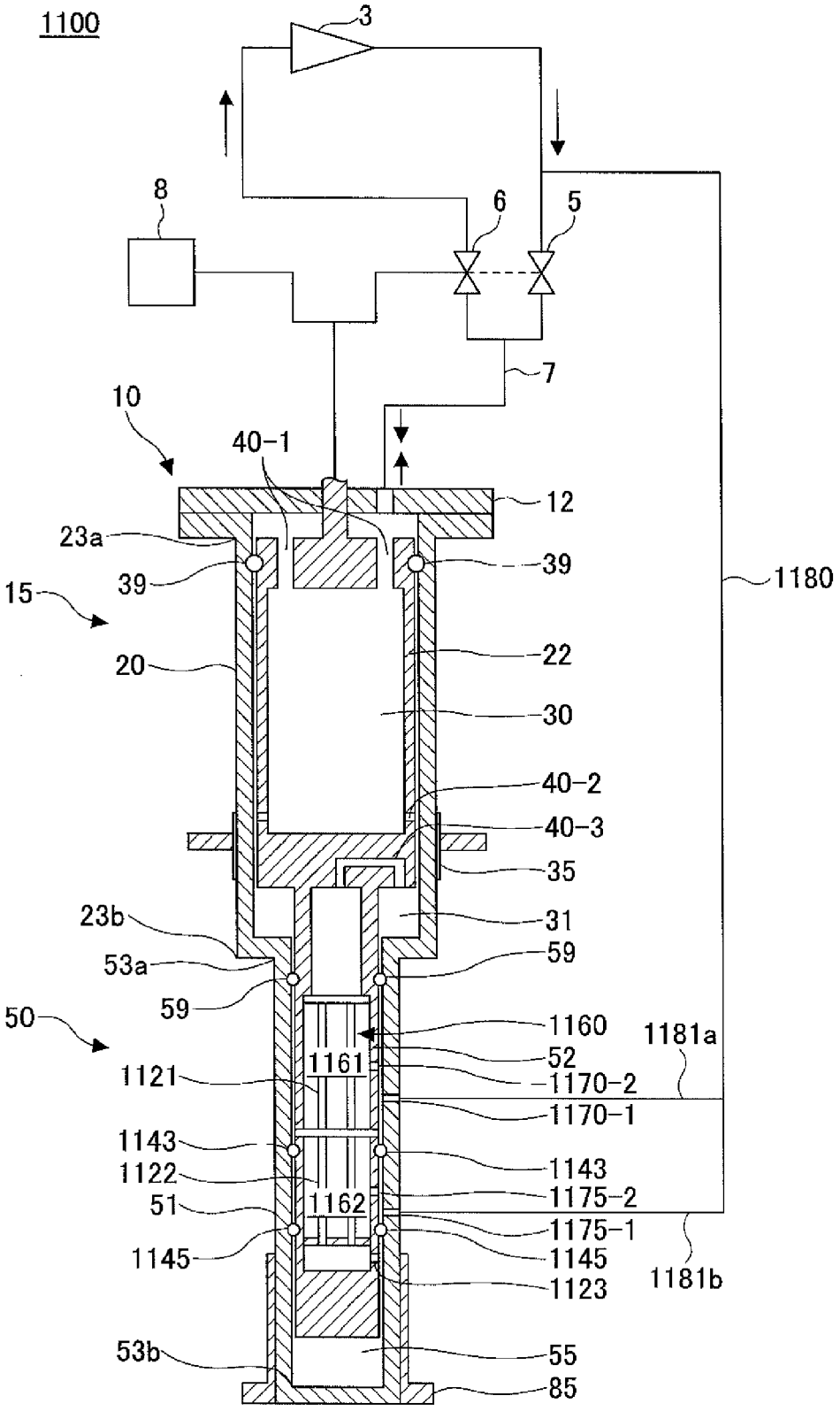
FIG. 19 is a diagram for schematically illustrating an example of a configuration of a GM refrigerator including the regenerator according to the embodiment.

FIG. 19 is a diagram for schematically illustrating an example of a configuration of the GM refrigerator including the regenerator according to the embodiment.

As illustrated in FIG. 19, the GM refrigerator 1100 includes the same elements as the conventional GM refrigerator 1 illustrated in FIG. 2. Thus, with respect to the GM refrigerator 1100, the same elements as the GM refrigerator 1 illustrated in FIG. 2 are indicated by the same reference numbers in FIG. 2.

However, the GM refrigerator 1100 differs from the GM refrigerator 1 described above in the configuration of the second stage displacer 52 which is provided in the second stage cylinder 51 such that it can reciprocate in an axial direction.

Specifically, the GM refrigerator 1100 has a second stage regenerator 1160 provided in the second stage displacer 52, instead of the second stage regenerator 60.

The second stage regenerator 1160 includes two spaces 1161 and 1162 arranged in an up-and-down direction. The first space 1161 is sealed by a second stage seal 59 and an intermediate seal 1143 with respect to the first expansion chamber 31 in which the working gas flows and the second space 1162. Further, the second space 1162 is sealed by the intermediate seal 1143 and a lower seal 145 with respect to the first space 1161 and the second expansion chamber 55 in which the working gas flows.

Further, the second stage cylinder 51 has a first flow channel 1170-1 and a second flow channel 1175-1 formed therein, and the second stage displacer 52 has a third flow channel 1170-2 and a fourth flow channel 1175-2 formed therein.

The second stage regenerator 1160 is provided with a pipe 1121 disposed in the first space 1161 and the second space 1162, and a pipe 1122 which is in fluid communication with the pipe 1121. For this reason, the working gas having flowed into the first stage expansion chamber 31 flows through the first space 1161 via the pipe 1121, through the second space 1162 via the pipe 1122, and then into the second expansion chamber 55 via a flow channel 1123 provided in the bottom part of the second displacer 52.

On the other hand, the high pressure pipe from the compressor 3 is connected to a branch pipe 1180 which has a first pipe 1181*a* and a second pipe 1181*b*. The first pipe 1181*a* is connected to the first flow channel 1170-1 of the second stage cylinder 51, and the second pipe 1181*b* is connected to the second flow channel 1175-1 of the second stage cylinder 51. Thus, a regenerator material from the compressor 3 can flow into the first space 1161 of the second stage regenerator 1160 from the pipe 1181*a* and the first flow channel 1170-1 of the second stage cylinder 51 via the third flow channel 1170-2 provided in the second stage displacer 52. Similarly, the regenerator material from the compressor 3 can flow into the second space 1162 of the second stage regenerator 1160 from the pipe 1181*b* and the second flow channel 1175-1 of the second stage cylinder 51 via the fourth flow channel 1175-2 provided in the second stage displacer 52.

It is apparent to those skilled in the art that the GM refrigerator 1100 described above has the same effects as the embodiments described above.

What is claimed is:

1. A helium-cooling type regenerator which accumulates the cold of working gas including helium, comprising:

at least first and second storage spaces along a temperature gradient direction in which the working gas flows, the first and second storage spaces accommodating helium gas as a regenerator material, the first storage space being coupled to a high-pressure side of a compressor via a first channel, the second storage space being coupled to a low-pressure side of the compressor via a second channel, the high-pressure side of the compressor being coupled to one end of a first regenerator material flow pipe, another end of the first regenerator material flow pipe being coupled to the first storage space, the low-pressure side of the compressor being coupled to one end of a second regenerator material flow pipe, another end of the second regenerator material flow pipe being coupled to the second storage space, wherein the first storage space includes a first working gas channel through which the working gas flows, the working gas being not in direct fluid communication with an inside of the first storage space, and the second storage space includes a second working gas channel through which the working gas flows, the working gas being not in direct fluid communication with an inside of the second storage space, the first storage space is disposed in a region on a high-temperature side, and accommodates the regenerator material whose pressure is P1 during an operation of the helium-cooling type regenerator, the second storage space is disposed in a region on a low-temperature side, and accommodates the regenerator material whose pressure is P2, which is less than P1, during the operation of the helium-cooling type regenerator, the second channel being not in direct fluid communication with the first channel, a specific heat of the regenerator material accommodated in the first storage space at the pressure P2 is less than that of the regenerator material at the pressure P1, and a specific heat of the regenerator material accommodated in the second storage space at the pressure P1 is less than that of the regenerator material at the pressure P2.

2. The helium-cooling type regenerator of claim 1, wherein the first storage space is disposed in a temperature region greater than 6 K, and/or the second storage space is disposed in a temperature region less than or equal to 10 K.

3. The helium-cooling type regenerator of claim 1, wherein the pressure P1 is greater than or equal to 0.8 MPa and less than or equal to 3.5 MPa, the pressure P2 is greater than or equal to 0.1 MPa and less than or equal to 2.2 MPa.

4. A pulse tube refrigerator, comprising:

a compressor for supplying working gas to a pulse tube via a cold accumulation tube and exhausting the working gas from the pulse tube via the cold accumulation tube;

wherein the cold accumulation tube includes the regenerator of claim 1.

* * * * *